US012044234B2

(12) United States Patent
Li et al.

(10) Patent No.: US 12,044,234 B2
(45) Date of Patent: Jul. 23, 2024

(54) COVER, FLUID END AND PLUNGER PUMP

(71) Applicant: Yantai Jereh Petroleum Equipment & Technologies Co., Ltd., Yantai (CN)

(72) Inventors: Xiaobin Li, Yantai (CN); Baojie Wang, Yantai (CN); Jixin Wang, Yantai (CN); Peng Li, Yantai (CN); Chen Jiang, Yantai (CN); Haiping Cui, Yantai (CN); Shulin Zhang, Yantai (CN); Anpeng Ge, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 31 days.

(21) Appl. No.: 17/846,050

(22) Filed: Jun. 22, 2022

(65) Prior Publication Data

US 2023/0138582 A1 May 4, 2023

(30) Foreign Application Priority Data

Nov. 1, 2021 (CN) ..... 202111282713.8
Nov. 1, 2021 (CN) ..... 202111283476.7
Nov. 1, 2021 (CN) ..... 202111283958.2

(51) Int. Cl.
*F04B 53/16* (2006.01)
*F04B 1/0404* (2020.01)
(Continued)

(52) U.S. Cl.
CPC ..... *F04B 53/162* (2013.01); *F04B 1/0404* (2013.01); *F04B 1/047* (2013.01);
(Continued)

(58) Field of Classification Search
CPC ..... F04B 53/162; F04B 1/0404; F04B 53/10; F04B 1/047; F04B 1/053; F04B 1/122;
(Continued)

(56) References Cited

U.S. PATENT DOCUMENTS 9,188,122 B1 * 11/2015 Reed ..... F16K 15/066
10,989,188 B2 4/2021 Surjaatmadja et al.
(Continued)

FOREIGN PATENT DOCUMENTS

CN 2481877 Y 3/2002
CN 203023039 U 6/2013
(Continued)

*Primary Examiner* — Charles G Freay
*Assistant Examiner* — David N Brandt
(74) *Attorney, Agent, or Firm* — XSENSUS LLP

(57) ABSTRACT

A cover, a fluid end and a plunger pump are provided. The cover includes: a body, the body being cylindrical, and the body including a first end, a second end, and a side surface connecting the first end and the second end; a main flow channel extending along an axis of the body; a plurality of subsidiary flow channels, each of the plurality of subsidiary flow channels being communicated with the main flow channel; a first opening, located at the first end and communicated with the main flow channel; and a plurality of second openings, located at the side surface of the body; each of the plurality of subsidiary flow channels being communicated with at least one of the plurality of second openings.

18 Claims, 20 Drawing Sheets

(51) Int. Cl.

| | |
|---|---|
| ***F04B 1/047*** | (2020.01) |
| ***F04B 1/053*** | (2020.01) |
| ***F04B 1/122*** | (2020.01) |
| ***F04B 1/182*** | (2020.01) |
| ***F04B 1/184*** | (2020.01) |
| ***F04B 53/10*** | (2006.01) |

(52) U.S. Cl.
CPC ..... *F04B 1/053* (2013.01); *F04B 1/122* (2013.01); *F04B 1/182* (2013.01); *F04B 1/184* (2013.01); *F04B 53/1025* (2013.01); *F04B 53/1032* (2013.01); *F04B 53/1035* (2013.01); *F04B 53/1087* (2013.01)

(58) Field of Classification Search
CPC ..... F04B 1/182; F04B 1/184; F04B 53/1025; F04B 53/1032; F04B 53/1035; F04B 53/1087; F04B 53/166; F04B 53/1022; F04B 53/16
See application file for complete search history.

(56) References Cited

U.S. PATENT DOCUMENTS

| | | | | |
|---|---|---|---|---|
| 2014/0348677 | A1* | 11/2014 | Moeller | F04B 39/1046 417/559 |
| 2015/0071803 | A1* | 3/2015 | Huang | F04B 39/1046 417/560 |
| 2016/0138585 | A1 | 5/2016 | Huang | |
| 2018/0363642 | A1 | 12/2018 | Salih et al. | |
| 2019/0063427 | A1* | 2/2019 | Nowell | F16K 1/427 |
| 2021/0148349 | A1* | 5/2021 | Nowell | F04B 53/007 |

FOREIGN PATENT DOCUMENTS

| | | | |
|---|---|---|---|
| CN | 203272121 | U | 11/2013 |
| CN | 203547609 | U | 4/2014 |
| CN | 204041422 | U | 12/2014 |
| CN | 204126882 | U | 1/2015 |
| CN | 205805894 | U | 12/2016 |
| CN | 205805898 | U | 12/2016 |
| CN | 207363864 | U | 5/2018 |
| CN | 208073737 | U | 11/2018 |
| CN | 208089530 | U | 11/2018 |
| CN | 109915357 | A | 6/2019 |
| CN | 111692064 | A | 9/2020 |
| CN | 211449007 | U | 9/2020 |
| CN | 212536832 | U | 2/2021 |
| CN | 112814891 | A | 5/2021 |
| CN | 112832973 | A | 5/2021 |
| CN | 112901477 | A | 6/2021 |
| CN | 113790151 | A | 12/2021 |
| CN | 113819051 | A | 12/2021 |
| CN | 113898574 | A | 1/2022 |
| CN | 216008868 | U | 3/2022 |
| CN | 216008869 | U | 3/2022 |
| CN | 216008879 | U | 3/2022 |

* cited by examiner

COVER, FLUID END AND PLUNGER PUMP

CROSS-REFERENCE TO RELATED APPLICATIONS

The present application claims priority to the Chinese patent applications No. 202111282713.8 filed on Nov. 1, 2021, No. 202111283476.7 filed on Nov. 1, 2021, and No. 202111283958.2 filed on Nov. 1, 2021. The disclosures of all of these applications are hereby incorporated herein by reference in their entirety.

TECHNICAL FIELD

The embodiments of the present disclosure relate to a cover, a fluid end and a plunger pump.

BACKGROUND

At present, fracturing operation is the main stimulation method in the process of oil and gas field exploitation, and a plunger pump is the main equipment for pumping fracturing medium in the stimulation operation. In other words, in the whole process of oil and gas exploitation, any process that needs to deliver medium into the well under a predetermined pressure needs to be realized by the plunger pump.

SUMMARY

The embodiments of the present disclosure provide a cover, a fluid end and a plunger pump.

In one aspect, the embodiments of the present disclosure provide a cover, a fluid end, and a plunger pump, so as to simplify the structure of the fluid end and provide a large displacement output.

The embodiment of the present disclosure provides a cover, which includes: a body, the body being cylindrical, and the body including a first end, a second end, and a side surface connecting the first end and the second end; a main flow channel extending along an axis of the body; a plurality of subsidiary flow channels, each of the plurality of subsidiary flow channels being communicated with the main flow channel; a first opening located at the first end and communicated with the main flow channel; and a plurality of second openings, located at the side surface of the body, each of the plurality of subsidiary flow channels being communicated with at least one of the plurality of second openings.

According to the cover provided by the embodiment of the present disclosure, the main flow channel is located on the axis of the body, and the main flow channel does not penetrate the body on the axis of the body.

According to the cover provided by the embodiment of the present disclosure, an aperture of the main flow channel is greater than an aperture of the subsidiary flow channel.

According to the cover provided by the embodiment of the present disclosure, the plurality of second openings are evenly distributed in a circumferential direction of the body.

According to the cover provided by the embodiment of the present disclosure, each of the plurality of subsidiary flow channels are obliquely arranged with respect to the main flow channel.

According to the cover provided by the embodiment of the present disclosure, an acute angle between a center line of the subsidiary flow channel and a center line of the main flow channel is in a range from 20 to 80 degrees.

According to the cover provided by the embodiment of the present disclosure, a distance between the subsidiary flow channel and the axis of the body gradually increases in a direction from the first end to the second end.

According to the cover provided by the embodiment of the present disclosure, the cover farther includes a drain channel, and a first drain outlet and a second drain outlet located at both ends of the drain channel the first drain outlet is located at the side surface of the body, and the second drain outlet is located at an end surface of the second end of the body.

According to the cover provided by the embodiment of the present disclosure, the drain channel is not communicated with the main flow channel, and is not communicated with the plurality of subsidiary flow channels.

According to the cover provided by the embodiment of the present disclosure, the first drain outlet is located at a side of the side face close to an end surface of the first end.

According to the cover provided by the embodiment of the present disclosure, the cover further includes a valve-seat groove, the valve-seat groove is located at the first end and is communicated with the main flow channel, and the valve-seat groove has a relief groove at a side of the valve-seat groove away from the first end.

According to the cover provided by the embodiment of the present disclosure, the cover further includes a first sealing position and a second sealing position, the first sealing position is configured to arrange a first sealing ring, the second sealing position is configured to arrange a second sealing ring, the first sealing position and the second sealing position are both located at the side surface, and the first drain outlet is located between the first sealing position and the second sealing position.

According to the cover provided by the embodiment of the present disclosure, the cover further includes a first sealing groove and a second sealing groove, the first sealing groove is configured to receive a first sealing ring, the second sealing groove is configured to receive a second sealing ring, the first sealing groove and the second sealing groove are both located at the side surface, and the first drain outlet is located between the first sealing groove and the second sealing groove.

According to the cover provided by the embodiment of the present disclosure, the cover further includes a pulling hole, the pulling hole is located at the second end of the body, and the pulling hole is not communicated with the second drain outlet.

According to the cover provided by the embodiment of the present disclosure, the pulling hole is located on the axis of the body.

The embodiment of the present disclosure further provides a fluid enol, which includes any one of the covers described above.

According to the fluid end provided by the embodiment of the present disclosure, the fluid end further includes: a valve casing including an inner chamber, the inner chamber including a low pressure chamber, a pressure-alternating chamber, and a high pressure chamber; the cover is located in the low pressure chamber, the inner chamber of the valve casing has art inverted T-shaped structure, the pressure-alternating chamber and the low pressure chamber are arranged along an extending direction of a first axis of the inner chamber, the pressure-alternating chamber and the high pressure chamber are arranged along an extending direction of a second axis of the inner chamber, and the first axis intersects with the second axis.

According to the fluid end provided by the embodiment of the present disclosure, the valve casing has an inlet hole, and the inlet hole and the high pressure chamber are staggered in the extending direction of the first axis.

According to the fluid end provided by file embodiment of the present disclosure, the fluid end further includes a first valve assembly, the first valve assembly is configured to be opened to communicate the low pressure chamber with the pressure-alternating chamber or configured to be closed to separate the low pressure chamber from the pressure-alternating chamber, the first valve assembly includes a spring bracket, and the spring bracket has a hollowed-out structure and is limited with the valve casing by an inclined surface.

According to the fluid end provided by the embodiment of the present disclosure, a first sub-chamber and a second sub-chamber are provided at an intersection position of the inner chamber, the first sub-chamber and the second sub-chamber are arranged along an extending direction of the second axis, and the second sub-chamber is closer to a portion of the inner chamber extending along the first axis than the first sub-chamber is, a maximum size of the second sub chamber in the extending direction of the second axis is greater than a maximum size of the first sub-chamber in the extending direction of the second axis, and a size of the second sub-chamber in the extending direction of the first axis gradually increases in a direction from a position away from the first axis to a position close to the first axis.

According to the fluid end provided by the embodiment of the present disclosure, the valve casing is provided with a protective sleeve at a position corresponding to both the first sub-chamber and the second sub-chamber.

According to the fluid end provided by the embodiment of the present disclosure, the fluid end further includes a second valve assembly, the second valve assembly is configured to be opened to communicate the pressure-alternating chamber with the high pressure chamber or configured to be closed to separate the pressure-alternating chamber from the high pressure chamber, and the second valve assembly and the second sub-chamber are located at opposite sides of the first sub-chamber.

The embodiment of the present disclosure further provides a plunger pump, which includes any one of the fluid ends described above.

In another aspect, the embodiments of the present disclosure provide a fluid end and a plunger pump, which is beneficial to maintaining and prolonging the service life of the valve casing.

The embodiment of the present disclosure provides a fluid end, which includes: a valve casing, including an inner chamber, the inner chamber including pressure-alternating chamber and a low pressure chamber; a first valve assembly configured to be opened to communicate the low pressure chamber with the pressure-alternating chamber or configured to be closed to separate the low pressure chamber from the pressure-alternating chamber; a first pressure bearing assembly located in the inner chamber; and a second pressure bearing assembly located in the inner chamber; the first valve assembly, the first pressure bearing assembly, and the second pressure bearing assembly are sequentially arranged along an extending direction of a first axis of the inner chamber.

According to the fluid end provided by the embodiment of the present disclosure, the first pressure bearing assembly is detachably connected with the valve casing, and the second pressure bearing assembly is detachably connected with the valve casing.

According to the fluid end provided by the embodiment of the present disclosure, the first pressure bearing assembly includes a pressure-alternating cover and a pressure-alternating nut, the pressure-alternating cover is closer to the first valve assembly than the pressure-alternating Ina is, and the pressure-alternating nut is in a threaded connection with the valve casing.

According to the fluid end provided by the embodiment of the present disclosure, a maximum length of the pressure-alternating cover on the first axis is less than a maximum length of the pressure-alternating nut on the first axis.

According to the fluid end provided by the embodiment of the present disclosure, a first sealing structure is arranged between the pressure-alternating cover and the valve casing, the valve casing has a drain channel, and the drain channel is configured to flow fluid therethrough in the case of failure of at least a pan of the first sealing structure.

According to the fluid end provided by the embodiment of the present disclosure, the drain channel penetrates a body of the valve casing.

According to the fluid end provided by the embodiment of the present disclosure, the drain channel is obliquely arranged with respect to the first axis of the inner chamber, and an acute angle formed by the drain channel and the first axis of the inner chamber is greater than or equal to 30 degrees and less than or equal to 60 degrees.

According to the fluid end provided by the embodiment of the present disclosure, the first sealing structure includes a first seal and a second seal, and one end of the drain channel close to the pressure-alternating cover is located between the first seal and the second seal.

According to the fluid end provided by the embodiment of the present disclosure, the first valve assembly includes a first valve body, a first sealing element, and a first valve seat, and the pressure-alternating cover serves as a base seat of the first valve seat.

According to the fluid end provided by the embodiment of the present disclosure, the pressure-alternating cover has a low pressure fluid channel, and the low pressure fluid channel is communicated with an inlet hole of the valve casing.

According to the fluid end provided by the embodiment of the present disclosure, the second pressure bearing assembly includes a suction cover and a suction nut, the suction cover is closer to the first pressure bearing assembly than the suction nut is, and the suction nut is in a threaded connection with the valve casing.

According to the fluid end provided by the embodiment of the present disclosure, the pressure-alternating cover and the suction cover are respectively arranged at opposite sides of the pressure-alternating nut.

According to the fluid end provided by the embodiment of the present disclosure, the fluid end further includes a second valve assembly and a third pressure bearing assembly, the inner chamber further includes a high pressure chamber, the second valve assembly is configured to be opened to communicate the pressure-alternating chamber with the high pressure chamber or configured to be closed to separate the pressure-alternating chamber from the high pressure chamber, the third pressure bearing assembly is located in the inner chamber and is arranged in sequence with the second valve assembly in an extending direction of a second axis of the inner chamber, a region of the inner chamber between the second valve assembly and the third pressure bearing assembly is the high pressure chamber, and the first axis intersects with the second axis.

According to the fluid end provided by the embodiment of the present disclosure, the inner chamber has an inverted T-shaped structure, and the pressure-alternating chamber and the high pressure chamber are arranged along the extending direction of the second axis of the inner chamber.

According to the fluid end provided by the embodiment of the present disclosure, the valve casing has an inlet hole, and the inlet hole and the high pressure chamber are staggered in the extending direction of the first axis.

According to the fluid end provided by the embodiment of the present disclosure, the first pressure bearing assembly and the second pressure bearing assembly are respectively arranged on both sides of the inlet hole in the extending direction of the first axis.

According to the fluid end provided by the embodiment of the present disclosure, a first sub-chamber and a second sub-chamber are provided at an intersection position of the inner chamber, the first sub-chamber and the second sub-chamber are arranged along the extending direction of the second axis, and the second sub-chamber is closer to a portion of the inner chamber extending along the first axis than the first sub-chamber is, a maximum size of the second sub-chamber in the extending direction of the second axis is greater than a maximum size of the first sub-chamber in the extending direction of the second axis, and a size of the second sub-chamber in the extending direction of the first axis gradually increases in a direction from a position away from the first axis to a position close to the first axis.

According to the fluid end provided by the embodiment of the present disclosure, the valve casing is provided with a protective sleeve at a position corresponding to both the first sub-chamber and the second sub-chamber.

According to the fluid end provided by the embodiment of the present disclosure, the first valve assembly includes a spring bracket, and the spring bracket has a hollowed-out structure and is limited with the valve casing by an inclined surface.

The embodiment of the present disclosure further provides a plunger pump, which includes any one of the fluid ends described above.

In another aspect, the embodiments of the present disclosure provide a fluid end, and the fluid end has a drain channel, which artificially creates a leakage point. Once the seal fails, it will be quickly and directly found, which is convenient for timely replacement of assembly parts, avoids the occurrence of large puncture leakage in the inner chamber and avoids safety accidents.

The embodiments of the present disclosure provide a fluid end, which includes a valve casing, including au inner chamber, the inner chamber including a pressure-alternating chamber and a low pressure chamber; a first valve assembly, located in the inner chamber, and configured to be opened to communicate the low pressure chamber with the pressure-alternating chamber or configured to be closed to separate the low pressure chamber from the pressure-alternating chamber; a pressure bearing, structure, at least a portion of the pressure hearing structure being located in the low pressure chamber; and a first sealing structure, located between the pressure bearing structure and the valve casing; at least one of the valve casing and the pressure bearing structure has a drain channel, and the drain channel is configured to flow fluid therethrougb in a case of failure of a part of the first sealing structure.

According to the fluid end provided by the embodiment of the present disclosure, the first sealing structure includes a first seal and a second seal, the drain channel includes a first drain outlet and a second drain outlet, the first drain outlet is closer to the first sealing structure than the second drain outlet is, and the first drain outlet is located between the first seal and the second seal.

According to the fluid end provided by the embodiment of the present disclosure, the drain channel is arranged in the valve casing, and the drain channel is obliquely arranged with respect to a first axis of the inner chamber.

According to the fluid end provided by the embodiment of the present disclosure, an acute angle formed by the drain channel and the first axis of the inner chamber is greater than or equal to 30 degrees and less than or equal to 60 degrees.

According to the fluid end provided by the embodiment of the present disclosure, the pressure bearing structure includes a first pressure bearing assembly and a second pressure bearing assembly, and the first valve assembly, the first pressure bearing assembly, and the second pressure bearing assembly are sequentially arranged along an extending direction of the first axis of the inner chamber.

According to the fluid end provided by the embodiment of the present disclosure, the first pressure bearing assembly includes a pressure-alternating cover and a pressure-alternating nut, the pressure-alternating cover is closer to the first valve assembly than the pressure-alternating nut is, and the pressure-alternating nut is in a threaded connection with the valve casing.

According to the fluid end provided by the embodiment of the present disclosure, the pressure bearing structure includes a cover and a nut, the nut is in a threaded connection with the valve casing, and the drain channel is located in the cover.

According to the fluid end provided by the embodiment of the present disclosure, the cover includes: a body, the body being cylindrical, and the body including a first end, a second end, and a side surface connecting the first end and the second end; a main flow channel, extending along an axis of the body; a plurality of subsidiary flow channels, each of the plurality of subsidiary flow channels being communicated with the main flow channel; a first opening, located at the first end and communicated with the main flow channel; and a plurality of second openings, located at the side surface of the body, each of the plurality of subsidiary flow channels being, communicated with at least one of the plurality of second openings.

According to the fluid end provided by the embodiment of the present disclosure, the cover has a low pressure fluid channel, and the low pressure fluid channel is communicated with an inlet hole of the valve casing.

According to the fluid end provided by the embodiment of the present disclosure, the inner chamber of the valve casing has an inverted T-shaped structure, and the pressure-alternating chamber and the low pressure chamber are arranged along an extending direction of a first axis of the inner chamber.

According to the fluid end provided by the embodiment of the present disclosure, the valve casing further includes a high pressure chamber the pressure-alternating chamber and the high pressure chamber are arranged along an extending direction of a second axis of the inner chamber, and the first axis intersects with the second axis.

According to the fluid end provided by the embodiment of the present disclosure, the valve casing has an inlet hole, and the inlet hole and the high pressure chamber are staggered in the extending direction of the first axis.

According to the fluid end provided by file embodiment of the present disclosure, the fluid end further includes a plunger, a packing assembly, a packing nut, a packing sleeve and a packing-sleeve nut, the inner chamber further including a plunger chamber, the plunger chamber is configured to place the plunger, the packing sleeve is located between the packing assembly and the valve casing, the packing-sleeve nut is configured to press the packing sleeve, and the packing nut is configured to press the packing assembly.

According to the fluid end provided by the embodiment of the present disclosure, a hardness of the packing sleeve is greater than a hardness of the valve casing, and the packing-sleeve nut is in a welded connection with the valve casing.

According to the fluid end provided by the embodiment of the present disclosure, the packing-sleeve nut is in a welded connection with the valve casing.

The embodiments of the present disclosure farther provide plunger pump, including any one of the fluid ends as described above.

BRIEF DESCRIPTION OF THE DRAWINGS in order to clearly illustrate the technical solution of the embodiments of the present disclosure, the drawings of the embodiments will be briefly described. It is obvious that the described drawings in the following are only related to some embodiments of the present disclosure and thus are not construed as any limitation to the present disclosure.

DETAILED DESCRIPTION

In order to make objectives, technical details, and advantages of the embodiments of the present disclosure more clear, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first", "second", etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the described object is changed, the relative position relationship may be changed accordingly.

As one of the key equipment for fracturing, the plunger pump is mainly used to transform the fracturing fluid with certain viscosity under normal pressure into a fracturing fluid with high pressure and large flow, so as to be injected into the ground formation, and the performance of the plunger pump directly affects the technical level of fracturing operation M oil and gas fields. At present, the structure of a fracturing pump at home and abroad generally adopts a reciprocating horizontal multi-cylinder plunger pump, such as three-cylinder plunger pump and five-cylinder plunger pump, which usually consists of a fluid end and a power end. The function of the fluid end is to convert mechanical energy into pressure energy of working fluid. The function of the power end is to transfer the kinetic energy of a prime mover to the fluid end through a deceleration transmission system and a crank-connecting rod mechanism.

Figure 1A:
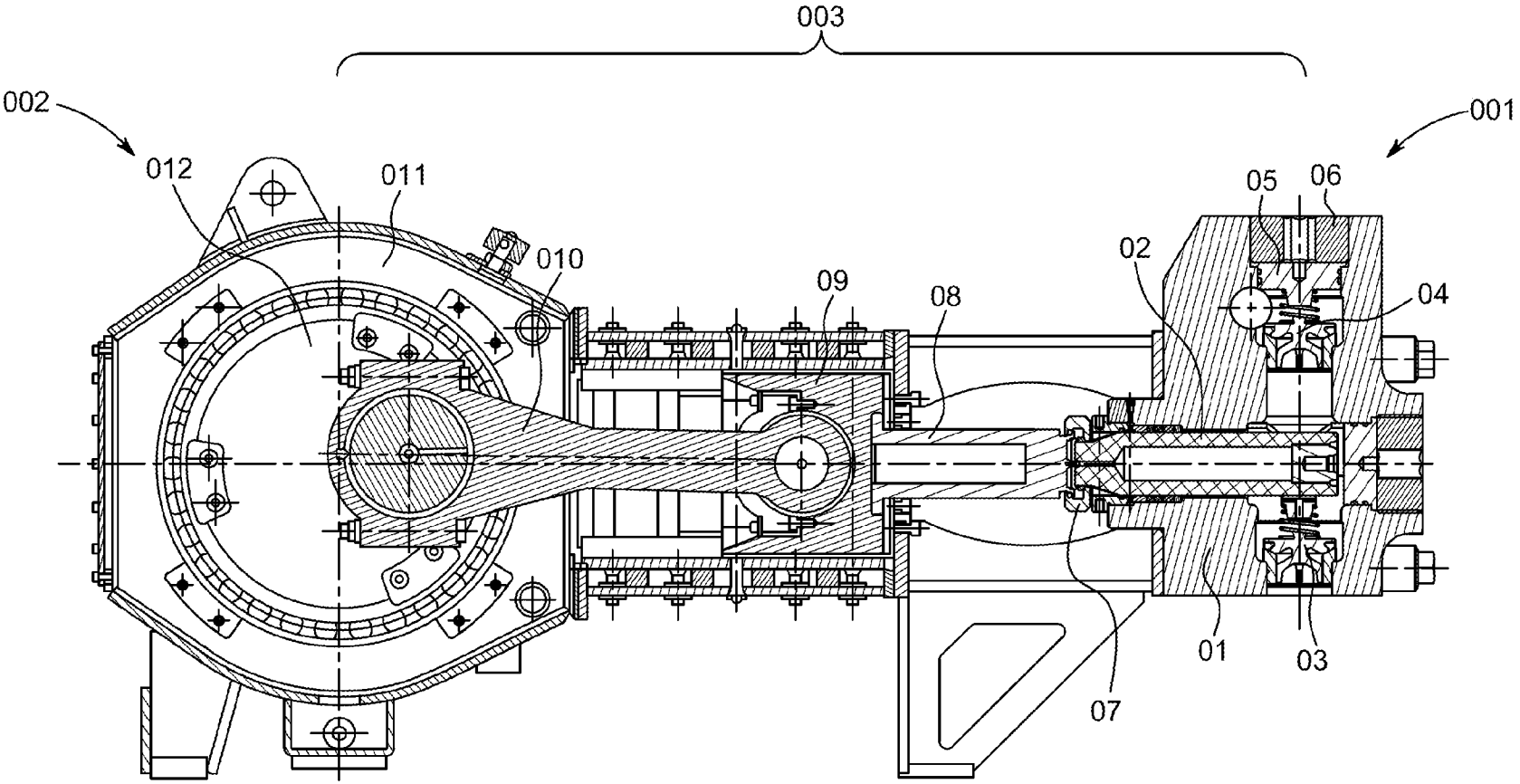
FIG. 1A is a cross-sectional view of a plunger pump.
Figure 1B:
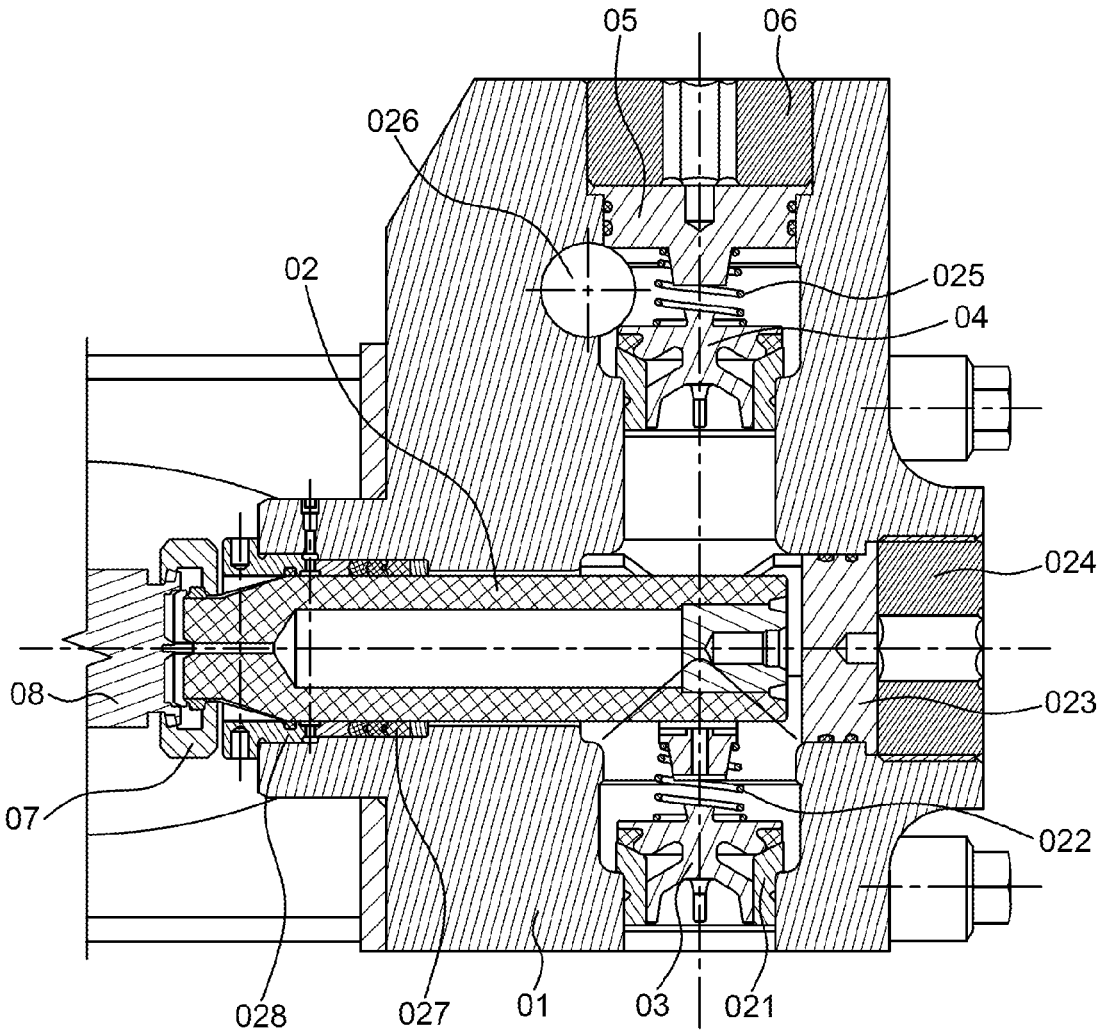
FIG. 1B is a schematic diagram of at fluid end in the plunger pump illustrated in FIG. 1A.
Figure 1C:
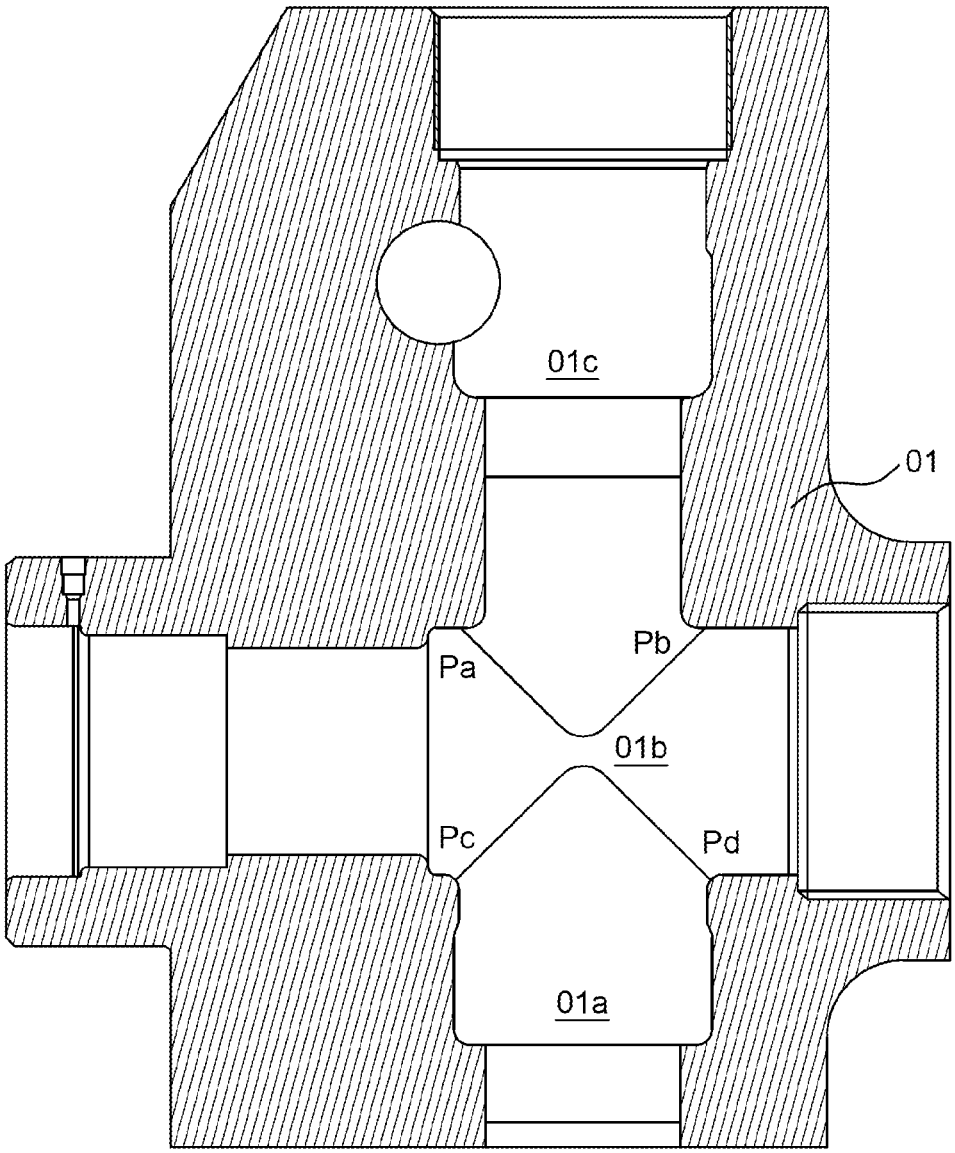
FIG. 1C is a schematic diagram of a valve casing in the fluid end illustrated in FIG. 1B.

FIG. 1A is a cross-sectional view of a plunger pump. FIG. 1B is a schematic diagram of a fluid end in the plunger pump illustrated in FIG. 1A. FIG. 1C is a schematic diagram of a valve casing in the fluid end illustrated in FIG. 1B. As illustrated in FIG. 1A, the plunger pump 003 includes a power end 002 and a fluid end 001. As illustrated in FIG. 1A and FIG. 1B, the fluid end 001 mainly includes a valve casing 01, a plunder 02, a valve assembly 03, a valve assembly 04, a sealing element, a cover 05, and a nut 06. FIG. 1A further illustrates a clamp 07, a pull rod 08, a crosshead 09, a connecting rod 010, a housing 011, and a crankshaft 012. As illustrated in FIG. 1B, the fluid end 001 further includes a valve seat 021, a spring 022, a suction cover 023, a suction nut 024, a spring 025, a fluid discharge hole 026, a packing assembly 027 for-sealing, and a packing nut 028. FIG. 1C illustrates a cross intersection structure of the valve casing 01.

As illustrated in FIG. 1A and FIG. 1B, the working principle of the plunger pump is as follows: under the drive of the prime mover, the crankshaft 012 of the power end 002 rotates to drive the connecting rod 010 and the crosshead 09 to reciprocate horizontally, and the crosshead 09 drives the plunger 02 to reciprocate horizontally in the valve casing 01 through the pull rod 08. When the plunger 02 moves back, the interior volume of the valve casing 01 gradually increases, thus forming a local vacuum. At this time, the valve assembly 03 is opened, the valve assembly 04 is closed, and the medium enters the inner chamber of the valve casing 01. When the plunger 02 moves back to a limit position, the inner chamber of the valve casing 01 is fully filled with the medium, and a sucking action is completed. When the plunger 02 moves forward, the interior volume of the valve casing 01 gradually decreases, the medium is squeezed, and the pressure increases. At this time, the valve assembly 04 is opened, and the valve, assembly 03 is closed. Under the pressure, the medium enters the fluid discharge hole 026. When the plunger 02 moves forward to an extreme position, the medium receiving space within the valve casing 01 is minimum, and the liquid discharge is completed. Due to the continuous reciprocating motion of the plunger 02, the processes of fluid suction and fluid discharge are alternately carried out, and the high pressure medium is continuously output.

Referring to FIG. 1A-FIG. 1C, the valve casing of the fluid end usually has a cross intersection structure. As illustrated in FIG. 1C, the inner chamber of the valve casing 01 is divided into a low pressure chamber 01*a*, a pressure-alternating chamber 01*b*, and a high pressure chamber 01*c* according to the pressure. However, the intersection line is just in the pressure-alternating chamber 01*b*, and mechanical analysis illustrates that the stress concentration at the intersection line is obvious. Coupled with the effect of alternating load, fatigue cracks are easy to occur at the intersection line, which results in cracking and leakage of the valve casing 01 and frequent replacement of the valve casing on site. And the replacement is costly, time-consuming and laborious.

With the increasing difficulty of fracturing operation (indicated by the increase of working pressure), single pump with large displacement has become an urgent demand of the market. If the stress concentration effect at the intersection has not been effectively alleviated, it will be difficult to prolong the service life of the valve casing.

The embodiments of the present disclosure provide a valve casing with a T-shaped inner chamber to prolong the service life of the valve casing, and provide a cover to simplify the structure of the fluid end and improve the performance of the fluid end. The embodiments of the present disclosure further provide a fluid end and a plunger pump which include the cover and the valve casing with the T-shaped inner chamber.

The cover, the fluid end, and the plunger pump provided by the embodiments of the present disclosure are introduced below.

Figure 2:
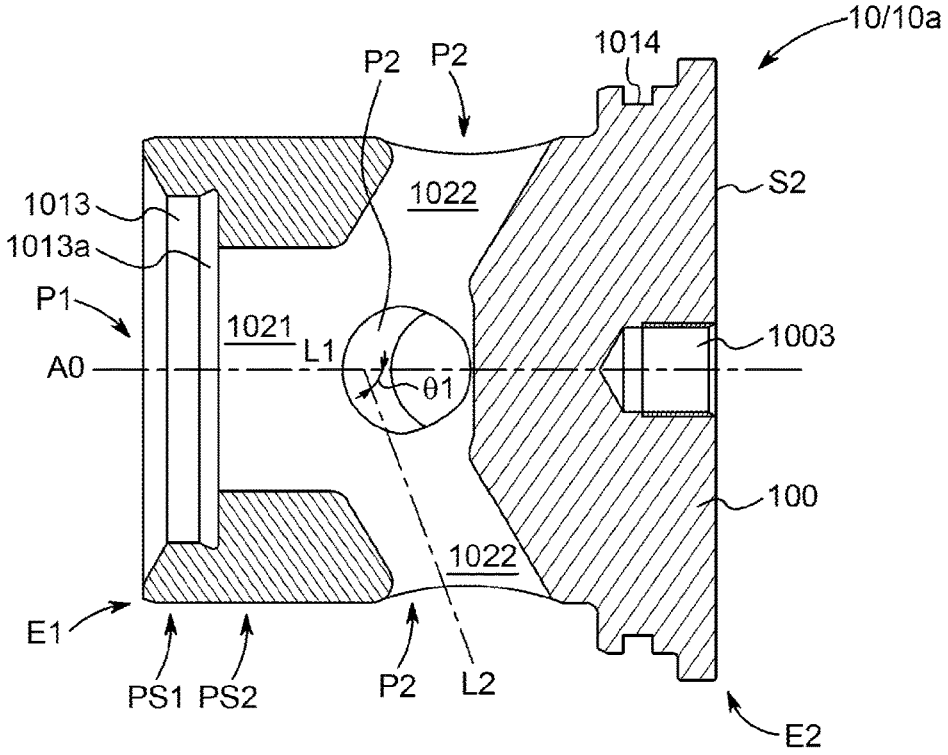
FIG. 2 is a cross-sectional view of a cover provided by an embodiment of the present disclosure.
Figure 3:
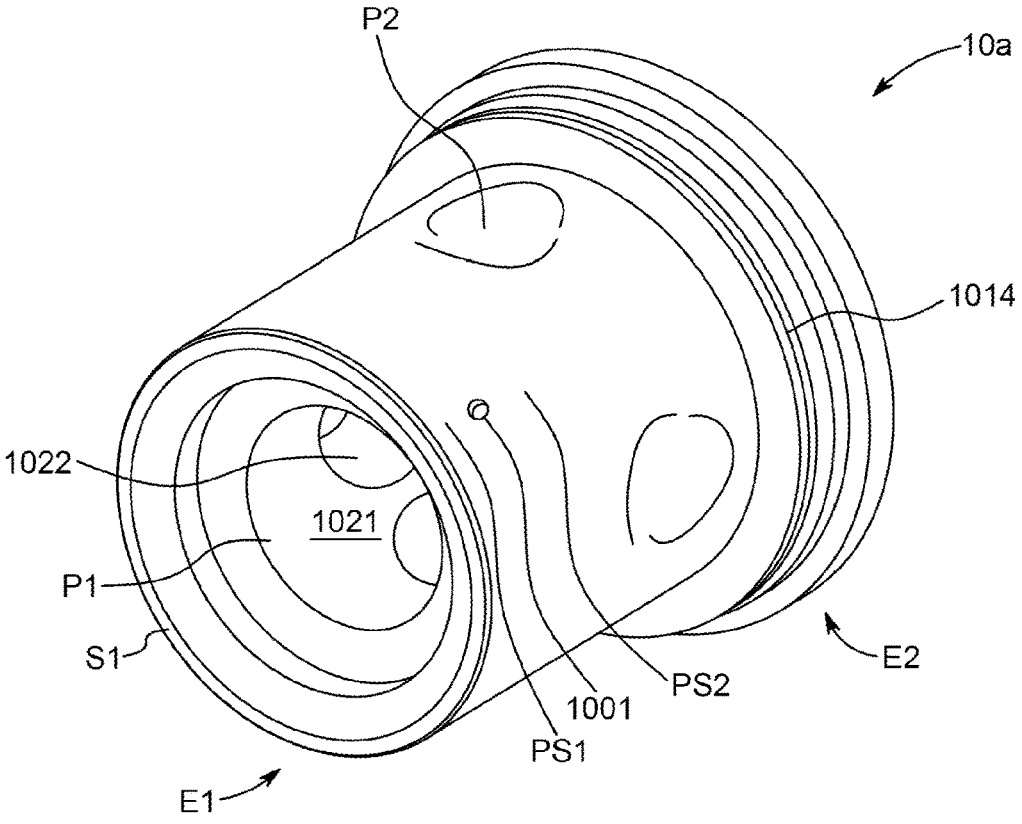
FIG. 3 is a perspective view of a cover provided by an embodiment of the present disclosure.
Figure 4:
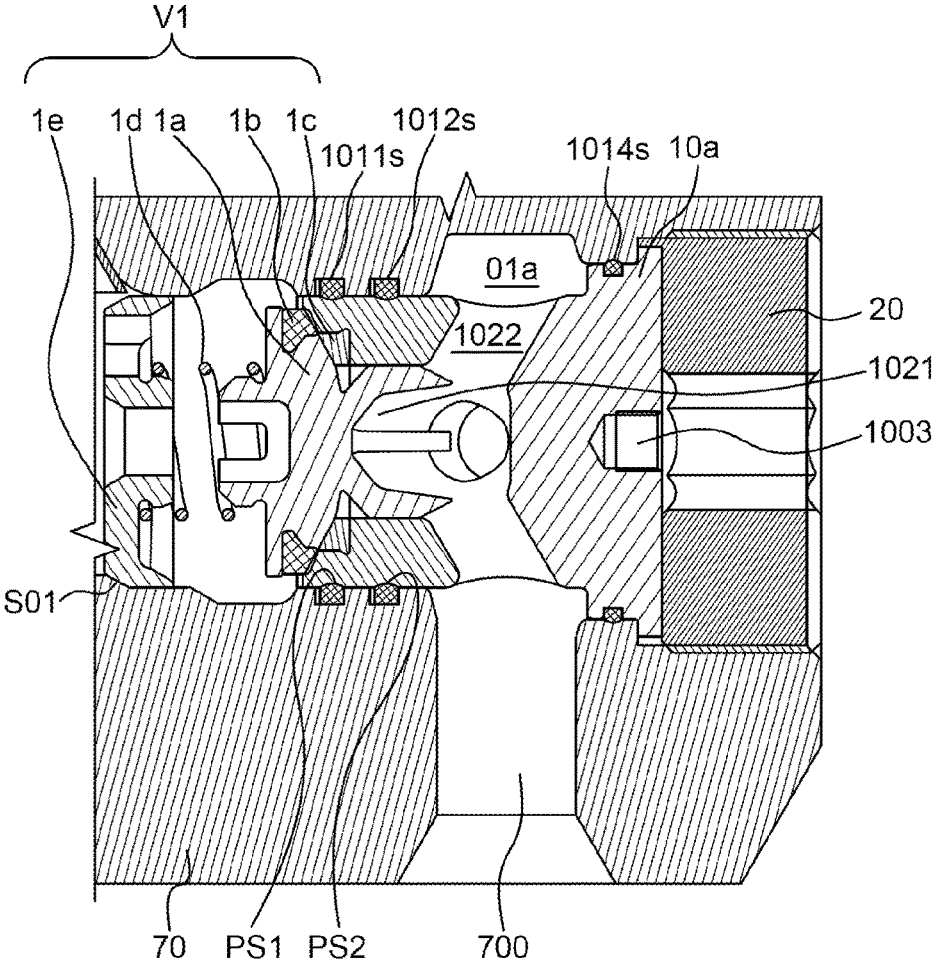
FIG. 4 is a cross-sectional view of a fluid end provided by an embodiment of the present disclosure.
Figure 5A:
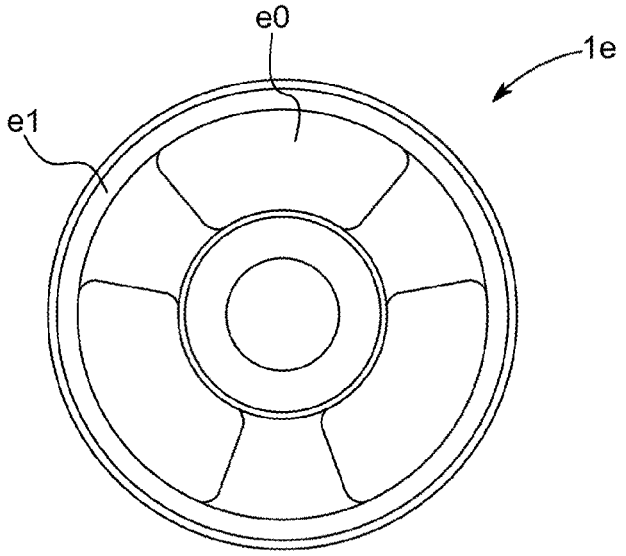
FIG. 5A is a front view and FIG. 5B is a side view of a spring bracket in a fluid end provided by an embodiment of the present disclosure.
Figure 5B:
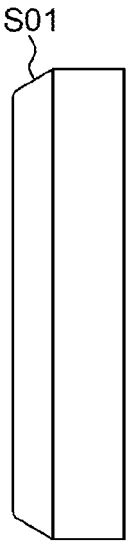
Figure 6:
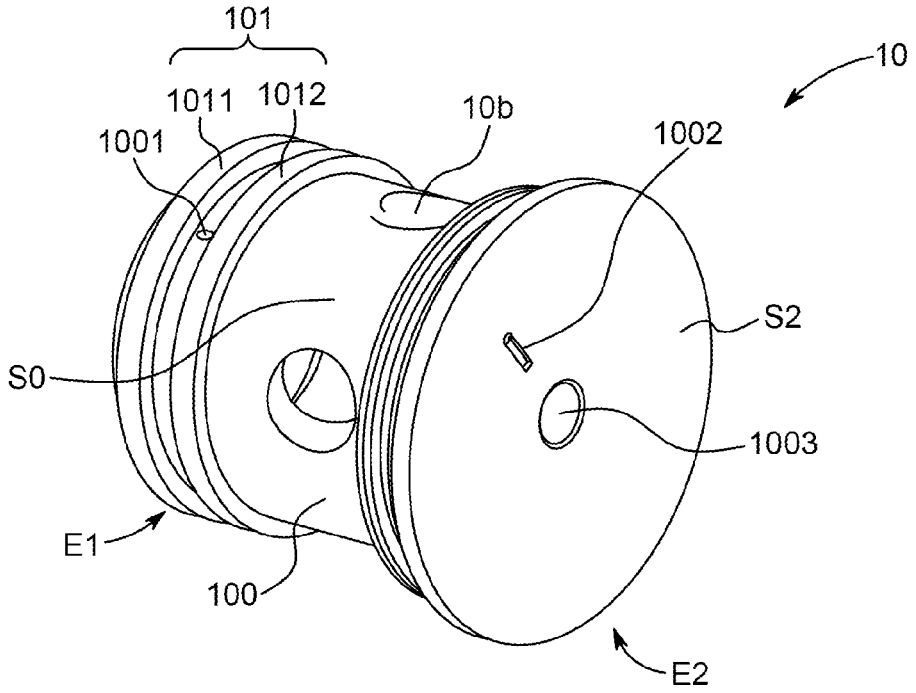
FIG. 6 is a perspective view of another cover provided by an embodiment of the present disclosure.
Figure 7:
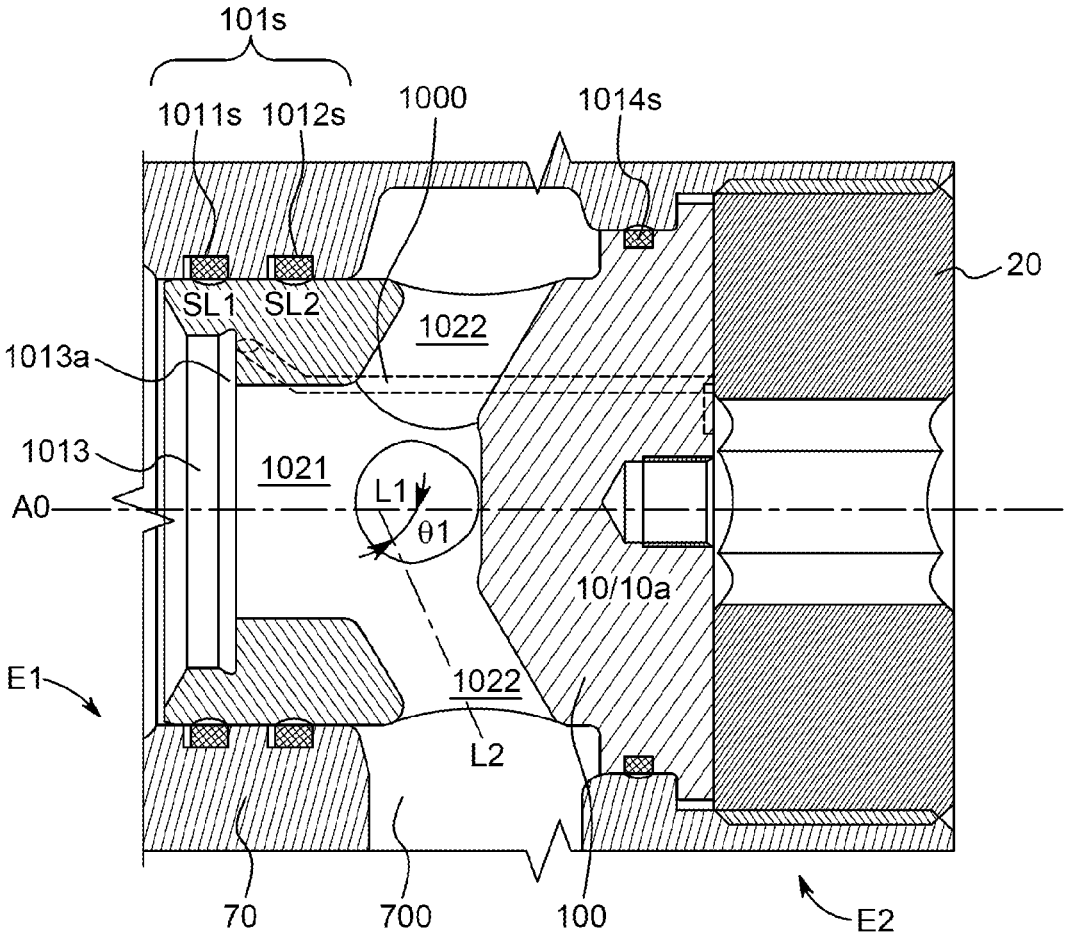
FIG. 7 is a cross-sectional view of a fluid end provided by an embodiment of the present disclosure.
Figure 8:
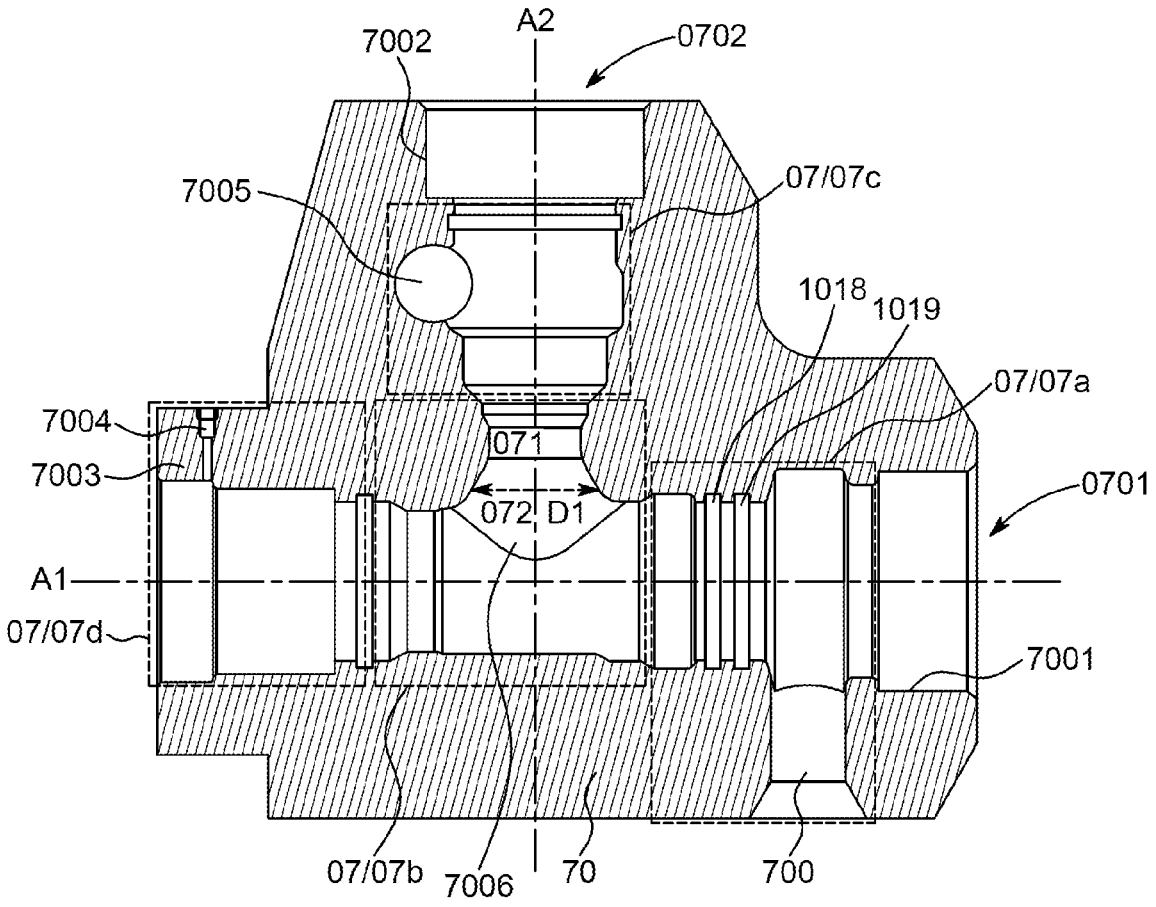
FIG. 8 is a cross-sectional view of a valve casing in a fluid end provided by an embodiment of the present disclosure.
Figure 9:
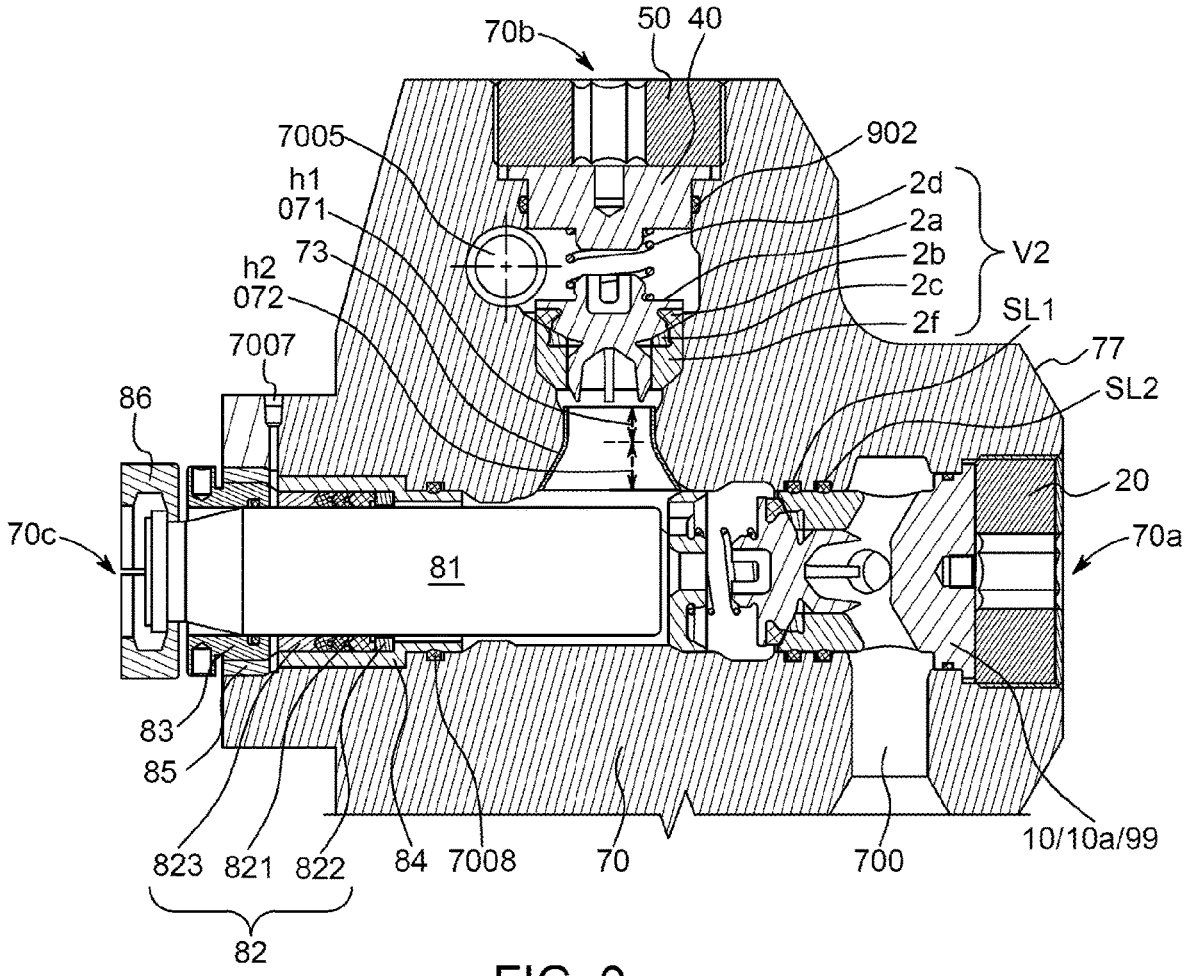
FIG. 9 is a cross-sectional view of a fluid end provided by an embodiment of the present disclosure.

FIG. 2 is a cross-sectional view of a cover provided by an embodiment of the present disclosure, FIG. 3 is a perspective view of a cover provided by an embodiment of the present disclosure. FIG. 4 is a cross-sectional view of a fluid end provided by an embodiment of the present disclosure. FIG. 5 is a front view and a side view of a spring bracket in a fluid end provided by an embodiment of the present disclosure. FIG. 5(*a*) is the front view of the spring bracket. FIG. 5(*b*) is the side view of the spring bracket. FIG. 6 is a perspective view of another cover provided by an embodiment of the present disclosure. FIG. 7 is a cross-sectional view of a fluid end provided by an embodiment of the present disclosure. FIG. 8 is a cross-sectional view of a valve casing in a fluid end provided by an embodiment of the present disclosure. FIG. 9 is a cross-sectional view of a fluid end provided by an embodiment of the present disclosure.

As illustrated in FIG. 2, FIG. 3 FIG. 6 and FIG. 7, the embodiment of the present disclosure provides a cover 10, and the cover 10 includes a body 100, a main flow channel 1021, a plurality of subsidiary flow channels 1022, a first opening P1, and a plurality of second openings P2. As illustrated in FIG. 2, FIG. 3, FIG. 6 and FIG. 7, the body 100 is cylindrical, and the body 100 includes a first end E1, a second end E2, and a side surface S0 connecting the first end E1 and the second end E2. The main flow channel 1021 extends along the axis of the body 100; each subsidiary flow channel 1022 is communicated with the main flow channel 1021: the first opening P1 is located at the first end E1 and is communicated with the main flow channel 1021; the plurality of second openings P2 are located at the side surface S0 of the body 100, and the subsidiary flow channel 1022 is communicated with at least one of the plurality of second openings P2.

The cover 10 provided by the embodiment of the present disclosure is beneficial to fluid passage and simplifying the structure of the fluid end, and the plunger pump including the cover can realize large displacement output.

FIG. 2-FIG. 4, FIG. 7 and FIG. 9 illustrate a cover 10*a*, and FIG. 6 illustrates a cover 10*b*.

For example, as illustrated in FIG. 2 and FIG. 7, the main flow channel 1021 is located on the axis A0 of the body 100, and the main flow channel 1021 does not penetrate the body 100 on the axis of the body 100. As illustrated in FIG. 2 and FIG. 7, the left end of the main flow channel 1021 is communicated with the first opening P1, and the right end of the main flow channel 1021 is communicated with the subsidiary flow channel 1022. For example, the main flow channel 1021 extends along the extending direction of the axis A0 of the body 100.

For example, as illustrated in FIG. 2 and FIG. 7, in order to facilitate fluid passage, the aperture of the main flow channel 1021 is greater than the aperture of the subsidiary flow channel 1022.

For example, as illustrated in FIG. 3 and FIG. 6, in order to realize stable output with large displacement, the plurality of second openings P2 are evenly distributed in the circumferential direction of the body 100. Because the second openings P2 are located at the side surface S0, the aperture of the subsidiary flow channel 1022 and the size of the second opening P2 can be set larger to facilitate the fluid to pass through the cover. The embodiment of the present disclosure is illustrated by taking that the cover 19 includes four second openings P2 evenly distributed in the circumferential direction of the body 100 as an example.

For example, as illustrated in FIG. 2 and FIG. 6, in order to improve the performance of the cover and prolong the service life of the cover, the subsidiary flow channels 1022 are obliquely arranged with respect to the main flow channel 1021.

In some embodiments, the plurality of subsidiary flow channels 1022 have the same inclination direction and the same inclination degree with respect to the main flow channel 1021. As illustrated in FIG. 2 and FIG. 7, the plurality of subsidiary flow channels 1022 are inclined to the right and have the same included angle with the main flow channel 1021.

For example, as illustrated in FIG. 2 and FIG. 7, the acute angle θ1 between the center line L2 of the subsidiary flow channel 1022 and the center line L1 of the main flow channel 1021 is in a range from 20 to 80 degrees. The cover illustrated in FIG. 2 and FIG. 7 is illustrated by taking that the center line L1 of the main flow channel 1021 coincides with the axis A0 of the main body 100 as an example.

For example, as illustrated in FIG. 2 and FIG. 7, the distance between the subsidiary flow channel 1022 and the axis A0 of the body 100 gradually increases in a direction from the first end E1 to the second end E2. That is, as illustrated in FIG. 2, the subsidiary flow channel 1022 is inclined to the right. Of course, in some other embodiments, the subsidiary flow channel 1022 can also be inclined to the left, and in this case, the distance between the subsidiary flow channel 1022 and the axis A0 of the body 100 gradually decreases in a direction from the first end E1 to the second end E2.

For example, as illustrated in FIG. 3, FIG. 6 and FIG. 7, the cover 10 further includes a drain channel 1000, and a first drain outlet 1001 and a second drain outlet 1002 at both ends of the drain channel 1000. The first drain outlet 1001 is located at the side surface S0 of the body 100, and the second drain outlet 1002 is located at the end surface S2 of the second end E2 of the body 100.

For example, as illustrated in FIG. 2-FIG. 4, the cover 10*a* further includes a first sealing position PS1 and a second sealing, position PS2, the first sealing position PS1 is configured to be provided with a first sealing ring 1011*s* therein, the second sealing position PS2 is configured to be provided with a second sealing ring 1012*s* therein, and the first sealing position PS1 and the second sealing position PS2 are located on the side surface S0.

For example, as illustrated in FIG. 2-FIG. 4, the first drain outlet 1001 is located between the first sealing position PS1 and the second sealing position PS2.

For example, as illustrated in FIG. 6, the cover 10*b* further includes a first sealing groove 1011 and a second sealing groove 1012, the first sealing groove 1011 is configured to receive a first sealing ring 1011*s*, the second sealing groove 1012 is configured to receive a second sealing ring 1012*s*, the first sealing groove 1011 and the second sealing groove 1012 are both located at the side surface S0. The first sealing groove 1011 and the first sealing ring 1011*s* form a first seal SL1, and the second sealing groove 1012 and the second sealing ring 1012*s* form a second seal SL2.

For example, as illustrated in FIG. 6, the first drain outlet 1001 is located between the first sealing groove 1011 and the second sealing groove 1012.

For example, the first sealing groove 1011 and the second sealing groove 1012 form a sealing groove 101. The first sealing ring 1011*s* and the second sealing ring 1012*s* forms the first sealing structure 101*s*.

For example, the drain channel 1000 is configured to flow fluid there (trough in the case of failure of a part of the first sealing structure 101.

For example, as illustrated in FIG. 3, FIG. 6 and FIG. 7, the drain channel 1000 is not in communication with the main flow channel 1021 and is not in communication with the subsidiary flow channel 1022.

For example, as illustrated in FIG. 3, FIG. 6 and FIG. 7, the first drain outlet 1001 is located at a side of the side surface S0 close to the end surface S1 of the first end E.

For example, as illustrated in FIG. 4 and FIG. 7. FIG. 9, the fluid end further includes a valve casing 70. The valve casing 70 includes an inner chamber 07. For example, as illustrated in FIG. 8 and FIG. 9, the inner chamber 07 of the valve casing 70 includes a low pressure chamber 07*a*, a pressure-alternating chamber 07*b* and a high pressure chamber 07*c*.

For example, in the embodiment of the present disclosure, the pressure of the thud in the high pressure chamber 07*c* is greater than the pressure of the fluid in the low pressure chamber 07*a*, and the pressure of the fluid in the pressure-alternating chamber 07*b* can change alternately.

As illustrated in FIG. 7 and FIG. 9, the fluid end includes a nut 20, and the nut 20 is in a threaded connection with the valve casing 70.

As illustrated in FIG. 6, one end (second drain outlet 1002) of the drain channel 1000 is formed by perforating the end surface 52 of the cover, and the other end (first drain outlet 1001) of the drain channel 1000 formed by perforating a circumference of the cover. The first drain outlet 1001 is located between the two seals (the first seal SL1 and the second seal SL2). When the first seal SL1 fails, fluid leakage occurs, and the annular chamber between the valve casing 70 and the cover 10 will be filled with fluid, and then the fluid will flow to the gap between the cover 10 and the nut 20 along the drain channel 1000. When a certain amount of fluid is accumulated, it will flow out along the outer circumference (at screw thread) or inner hole of the nut 20. At this time, it is observed that there is fluid leakage, indicating, that the first seal SL1 has failed. Thus, the operator will judge the use condition of the first seal SL1 according to whether there is fluid leakage herein, so as to react in time when the first seal SL1 fails, while failure to react in time may cause the high pressure fluid to plunge into the low pressure fluid after the second seal SL2 fails, resulting in crosstalk in pressure and equipment damage.

For example, as illustrated in FIG. 2 and FIG. 7, the cover 10 further includes a valve-seat groove 1013 the valve-seat groove 1013 is located at the first end E1 and is communicated with the main flow channel 1021, and the valve-seat groove 1013 has a relief groove 1013*a* at a side of the valve-seat groove 1013 away from the first end E1 for reducing stress concentration.

For example, in order to facilitate disassembly and assembly of the cover during maintenance, the cover 10 further includes a pulling hole 1003, the pulling hole 1003 is located at the second end E2 of the body 100. The pulling hole 1003 is not communicated with the second drain outlet 1002 and is not communicated with the drain channel 1000. For example, the pulling hole 1003 is located on the axis of the body 100.

For example, as illustrated in FIG. 2-FIG. 4, FIG. 6-FIG. 7 and FIG. 9, flow channels (main flow channel 1021, subsidiary flow channels 1022) and the drain channel 1000 are provided at the inner side of than cover 10, the pulling hole 1003 and the valve-seat groove 1013 are provided at the end surface of the covet 10, and a sealing groove can be provided at the circumference of the cover 10. Low pressure fluid flows in the flow channels, and the main flow channel 1021 and the subsidiary flow channels 1022 are intersected. The axis of the main flow channel 1021 (the center line L1 of the main flow channel 1021) coincides with the axis of the cover 10, and the subsidiary flow channels 1022 are evenly distributed in the circumferential direction of the cover. The bottom of the valve-seat groove 1013 is flat, the side surface of the valve-seat groove 1013 is conical, the root of the valve-seat groove 1013 is provided with a relief groove 1013*a* to reduce stress concentration, and the corresponding valve seat is also provided with a conical surface to match and fix with the valve-seat groove 1013.

For example, in some embodiments, as illustrated in FIG. 2 and FIG. 3, the sealing groove is not provided on the left side of the cover of the fluid end, the sealing groove is provided on the valve casing, and the circumference of the cover 10 is in interference fit with the sealing element to avoid crosstalk in pressure of the high and low pressure fluids. As illustrated in FIG. 8 and FIG. 9, after the cover 10 is worn by the sealing element (the first sealing ring 1011*s* and the second sealing ring 1012*s*), the cover can be replaced to reduce the cost of maintenance. It should be noted that, as illustrated in FIG. 6, a sealing groove 101 can also be provided on the left side of the cover, which is not limited to the case that the sealing groove is provided on the valve casing 70. FIG. 8 illustrates the sealing groove 1018 and the sealing groove 1019 in the valve casing 70. As illustrated in FIG. 7 and FIG. 8, the first sealing ring 1011*s* is arranged in the sealing groove 1018, and the second sealing ring 1012*s* is arranged in the sealing groove 1019.

The cover 10 provided by the embodiment of the present disclosure includes at least one of the following beneficial effects.

(1) The cover integrates functions of the end plug, the flow channel, and the base seat, and integrates multiple functions in itself, so that the entire structure of the fluid end is more compact and simple, and it can be fixed and limited by using the nut in the traditional fluid end.

(2) The cover is used as the base seat of the valve seat. When the valve seat is worn and needs to be replaced, it can be replaced with the cover as a whole, and other tools are not needed to pull it out again, so as to avoid lowering, the maintenance efficiency. After all, the maintenance time during fracturing operation is very short, and the maintenance efficiency on site can be greatly improved by using the whole replacement.

(3) The built-in drain channel of cover can be used to quickly and directly determine whether the seal is invalid, and prevent the equipment from being: damaged and prevent fracturing operation from being affected due to the crosstalk in pressure caused by untimely discovery of the invalid seal.

(4) The hollowed-out structure (flow channels) of the cover makes the low pressure fluid flow smoothly, and the fracturing fluid is generally sand-mixed fracturing and the risk of sand plugging can be reduced by the combined use of the plurality of subsidiary flow channels and the large-aperture main flow channel.

The embodiment of the present disclosure further provides a fluid end, which includes any one of the covers 10 mentioned above.

The inner chamber of the valve casing of the fluid end provided by the embodiment of the present disclosure has a T-shaped structure, and the intersection position is designed in a "bell mouth" form, so that the problem of stress concentration at the intersection line of the inner chamber is alleviated. The valve casing 70 can be referred to as a T-shaped valve casing.

For example, as illustrated in FIG. 8 and FIG. 9, the cover 10 is located in the low pressure chamber 07*a*, the inner chamber 07 of the valve casing 70 has an inverted T-shaped structure, the pressure-alternating chamber 07*b* and the low pressure chamber 07*a* are arranged along the extending direction of the first axis A1 of the inner chamber 07, the pressure-alternating chamber 07*b* and the high pressure chamber 07*c* are arranged along the extending direction of the second axis A2 of the inner chamber 07, and the first axis A1 intersects with the second axis A2. The embodiment of the present disclosure is illustrated by taking that the first axis A1 is perpendicular to the second axis A2 as an example.

FIG. 8 illustrates the first axis A1 and the second axis A2 of the inner chamber 07. As illustrated in FIG. 8, the inner chamber 07 includes a horizontal chamber 0701 and a vertical chamber 0702.

For example, as illustrated in FIG. 8 and FIG. 9, the inner chamber of the valve casing 70 has a T-shaped structure. According to the installation positions of the first valve assembly and the second valve assembly, the inner chamber 07 is divided into a low pressure chamber 07*a*, a pressure-alternating chamber 07*b*, and a high pressure chamber 070. The intersection position of the inner chamber 07 is designed a in a "bell mouth" form with smooth transition, which can effectively alleviate the stress concentration effect.

Compared with the valve casing of a traditional fluid end, the structure of the valve casing of the fluid end provided by the embodiment of the present disclosure has the following characteristics.

1) The stress concentration effect in the inner chamber is obviously alleviated.

The inner chamber with the cross intersection structure is illustrated in FIG. 1C, and the intersection position includes position Pa, position Pb, position Pc, and position Pd. The stress concentration points are at position Pc and position Pd, the stress concentration is very obvious from the mechanical analysis, and fatigue cracks are easy to occur, leading to cracking of the valve casing.

There is no right angle at the intersection position of the inner chamber of the valve casing of the fluid end provided by the embodiment of the present disclosure, the transition of the intersection position of the inner chamber is smooth, the optimized design is carried out at the position where stress concentration is most likely to occur, the intersection position is in the shape of a bell mouth, there is no stress concentration point, and the stress concentration effect is obviously alleviated from the mechanical analysis.

2) The structure is simple and the sealing performance is strong.

The valve casing in a traditional fluid end has a separated structure, and the packing chamber, the suction chamber (low pressure chamber), and the discharge chamber (high pressure chamber) need to be fastened to the body of the valve casing with bolts. This structure is rather complicated and needs a variety of seals for sealing, which virtually increases many leakages. The higher the machining accuracy of sealing surfaces and the more the sealing surfaces, the more the working hours being needed, and the lower the machining efficiency, and finally the sealing cannot be fully guaranteed.

The valve casing of the fluid end provided by the embodiment of the present disclosure has an integral structure, which is tightly sealed and has high pressure resistant, uses fewer seals and does not need bolts, has a simple and compact structure, and has low risk of puncture leakage of the valve casing.

3) Maintenance is convenient.

In a traditional fluid end, the axis of the plunger is not collinear with the axis of the valve casing, and the plunger cannot lie pulled out from the suction side. When the plunger is damaged or the packing assembly needs to be replaced, the whole fluid end needs to be disassembled. Because the fluid end is heavy, the crane will be used to assist in this process, which greatly reduces the maintenance efficiency. During the actual fracturing operation, the employer will not leave a long time to replace the assembly parts. In some traditional fluid ends, although the axis of the plunger is collinear with the axis of the horizontal chamber of the valve casing, there are many inconveniences in maintenance. For example, when maintaining the plunger or packing assembly, the plunger has a large diameter and cannot be pulled out from the inner chamber of the valve casing. The whole fluid end needs to be disassembled for maintenance. Even if the plunger has a small diameter and can be pulled out from the inner chamber of the valve casing, the suction side also needs to be disassembled before maintenance can be carried out.

The fluid end provided by the embodiment of the present disclosure does not have the above-mentioned problem of inconvenient maintenance, the axis of the plunger coincides with the first axis (horizontal axis) of the valve casing, the suction side is provided with a nut, and the axis of the nut coincides with the axis of the plunger, so the maintenance can be carried out according to the routine operation of the well site.

For example, the most efficient routine operation of maintaining the plunger or packing assembly on the well site is: disassembling the nut on the suction side, opening the horizontal chamber of the valve casing, disassembling the clamp, "disconnecting" the fluid end from the power end, pulling the plunger out from the suction side along the axis of the horizontal chamber of the valve casing by using a pulling tool, and carrying out normal maintenance; and after maintenance, reversing the operations according to the above actions to restore the assembly parts. The fluid end does not need to be disassembled from the plunger pump in the whole maintenance process.

For example, as illustrated in FIG. 4 and FIG. 7-FIG. 9, the valve casing 70 has an inlet hole 700, and the inlet hole 700 and the high pressure chamber 07*c* are staggered in the extending direction of the first axis A1.

For example, as illustrated in FIG. 4 and FIG. 9, the fluid end further includes a first valve assembly V1, and the first valve assembly V1 is configured to be opened to communicate the low pressure chamber 07*a* with the pressure-alternating chamber 07*b* or configured to be closed to separate the low pressure chamber 07*a* from the pressure-alternating chamber 07*b*.

For example, as illustrated in FIG. 4 and FIG. 9, the first valve assembly V1 includes a valve body 1*a*, a sealing element 1*b* (playing a role of sealing), a valve seat 1*c*, a spring 1*d*, and a spring bracket 1*e*.

For example, as illustrated in FIG. 4 and FIG. 9, the sealing element 1*b* is embedded in the valve body in when the first valve assembly V1 is opened, the valve body 1*a* embedded with the sealing element 1*b* moves to the left, and the low pressure chamber 07*a* and the pressure-alternating chamber 07*b* are communicated with each other.

As illustrated in FIG. 5, the spring bracket 1*e* has a hollowed-out structure, includes a main body e1 and a hollowed-out structure e0, and is limited with the valve casing 70 by an inclined surface S01. The spring bracket 1*e* having the hollowed-out structure e0 is beneficial to smoothing fluid passage, and is limited by the inclined surface S01, so as to prevent the spring, bracket 1*e* from shaking in the horizontal chamber of the valve casing 70. Correspondingly, the horizontal chamber of the valve casing is also provided with an inclined surface to match with the inclined surface of the spring bracket 1*e*, and the spring bracket 1*e* is in contact with the valve casing 70 through the inclined surface.

For example, as illustrated in FIG. 9, the fluid end further includes a second valve assembly V2, and the second valve assembly V2 is configured to be opened to communicate the pressure-alternating chamber 07*b* with the high pressure chamber 07*c* or configured to be closed to separate the pressure-alternating chamber 07*b* from the high pressure chamber 07*c*.

For example, as illustrated in FIG. 9, the second valve assembly V2 includes a valve body 2*a*, a sealing element 2*b* (playing a role of sealing), a valve seat 2*c*, a spring 2*d*, and a base seat 2*f*.

For example, as illustrated in FIG. 9, the sealing element 2*b* is embedded in the valve body 2*a*. When the second valve assembly V2 is opened, the valve body 2*a* embedded with the sealing element 2*b* moves upward, and the high pressure chamber 07*c* and the pressure-alternating chamber 07*b* are communicated with each other.

As illustrated in FIG. 9, the second valve assembly V2 is close to a discharge hole 7005, and is opened when the plunger moves forward, so as to flow high pressure fluid; the first valve assembly V1 is close to the inlet hole 700, and is opened when the plunger moves back, so as to flow low pressure fluid; the base seat 2*f* of the second valve assembly V2 is directly embedded in the valve casing 70, and the hardness of the base seat 2*f* is higher than the hardness of the valve casing 70, which can prevent the valve casing 70 from being damaged during opening and closing (lapping) of the second valve assembly V2 and prolong the service life of the valve casing 70.

For example, as illustrated in FIG. 8, the intersection position 7006 of the inner chamber 07 of the valve casing 70 is formed into a bell mouth shape by machining. For example, the bell mouth shape can be machined by means of boring, but it is not limited to this case.

For example, as illustrated in FIG. 8 and FIG. 9, the intersection position of the inner chamber 07 includes a first sub-chamber 071 and a second sub-chamber 072, the first sub-chamber 071 and the second sub-chamber 072 are arranged along the extending direction of the second axis A2. The second sub-chamber 072 is closer to the portion (horizontal chamber) of the inner chamber 07 extending along the first axis A1 than the first sub-chamber 071 is. In order to alleviate stress concentration, the maximum size h2 of the second sub-chamber 072 in the extending direction of the second axis A2 is greater than the maximum size h1 of the first sub-chamber 071 in the extending direction of the second axis A2. The second valve assembly V2 is not placed in the first sub-chamber 071 or the second sub-chamber 072. The second valve assembly V2 is located at the outer side of the first sub-chamber 071 and the second sub-chamber 072. The first sub-chamber 071 and the second sub-chamber 072 can be empty cavities only for flowing fluid. For example, as illustrated in FIG. 8 and FIG. 9, the second valve assembly V2 and the second sub-chamber 072 are located on opposite sides of the first sub-chamber 071.

For example, as illustrated in FIG. 8 and FIG. 9, in order to alleviate stress concentration, the size D1 of the second sub-chamber 072 in the extending direction of the first axis A1 gradually increases in a direction from a position away from the first axis A1 to a position close to the first axis A1.

For example, the portion of the valve casing 70 for forming the second sub-chamber 072 has an included angle of 0-80 degrees with the first axis A1. Further, for example, the portion of the valve casing 70 for forming the second sub-chamber 072 has an included angle of 30-60 degrees with the first axis A1.

For example, as illustrated in FIG. 9, the first sub-chamber 071 is a cylindrical chamber, but it is not limited to this case. For example, as illustrated in FIG. 9, the second sub-chamber 072 is a truncated cone chamber, but it is not limited to this case.

For example, as illustrated in FIG. 9, the valve casing 70 is provided with a protective sleeve 73 at the positions corresponding to the first sub-chamber 071 and the second sub-chamber 072. There is a protective sleeve 73 at the "bell mouth" position of the inner chamber 07 of the valve casing 70 to protect the inner chamber 07 and prolong the service life of the valve casing 70.

For example, as illustrated in FIG. 9, the cover 10 has a revolving structure, which is horizontally placed inside the valve casing 70, with the left side in contact with the first valve assembly V1 and the right side in contact with the nut 20. The nut is screwed with the valve casing 70.

For example, as illustrated in FIG. 9, the fluid end includes a plunger 81. The plunger 81 is a revolving body, one end of the plunger 81 is in contact with the fluid in the valve casing 70 and reciprocates, and the other end of the plunger 81 is connected to the power end of the plunger pump through a clamp 86. For example, as illustrated in FIG. 9, the fluid end further includes a plunger side 70*c*.

For example, as illustrated in FIG. 8, the inner chamber 09 further includes a plunger chamber 07*d*, and the plunger chamber is configured to place the plunger 81. The plunger chamber 07*d*, the pressure-alternating chamber 07*b*, and the low pressure chamber 07*d* are arranged in sequence along the extending direction of the first axis A1 of the inner chamber 07.

For example, in the embodiment of the present disclosure, the extending direction of the first axis A1 can be the arrangement direction of the pressure-alternating chamber 07*b* and the low pressure chamber 07*a*, or the extending direction of the first axis A1 can be the arrangement direction of the plunger chamber 07*d*, the pressure-alternating chamber 07*b*, and the low pressure chamber 07*a*. For example, in the embodiment of the present disclosure, the extending direction of the second axis A2 can be the arrangement direction of the high pressure chamber 07*c* and the pressure-alternating chamber 07*b*.

For example, as illustrated in FIG. 9, the fluid end further includes a packing assembly 82, and the packing assembly 82 includes a package 821, a spacer ring 822, and a press ring 823.

For example, as illustrated in FIG. 9, the package 821 includes three packing rings. Of course, the number of packing rings is not limited to that illustrated in the figure, but can be determined as needed. For example, the material of the packing ring includes rubber, but is not limited to this case.

For example, as illustrated in FIG. 9, the plunger side of the valve casing, is provided with a lubricating oil passage 7007 for lubricating the package 821 (rubber element), so as to make the reciprocating motion of the plunger 81 smoother; the circumference of the plunger 81 is wrapped by the package 821, the package 821 plays a role of sealing to prevent fluid leakage when the plunger 81 reciprocates.

For example, as illustrated in FIG. 9, the inner wall of the package 821 is in interference fit with the plunger 81, which plays a role of sealing; when the plunger 81 reciprocates, it rubs against the inner wall of the package 821, and the forced lubrication here can reduce the friction.

For example, the front end of the plunger 81 is provided with a pulling hole (bolt hole), which is matched with a pulling tool. During, maintenance, the clamp 86 is firstly disassembled and the plunger 81 is disconnected from the power end, and the plunger 81 is pulled out from the suction side 70*a* along the first axis A1 of the valve casing 70 by the pulling tool.

For example, as illustrated in FIG. 9, the fluid end further includes a packing nut 83, and the packing nut 83 is configured to press the packing assembly 82.

For example, as illustrated in FIG. 9, the fixing of the package 821 is reinforced by the packing nut 83, and the packing nut 83 is in a threaded connection with the valve casing 70. The functions of the packing, nut 83 include: preventing the package 821 from moving axially when the plunger 81 reciprocates, and expanding the package 821 by screwing and squeezing, which is beneficial to sealing. The spacer ring 822 and the press ring 823 are provided at both ends of the package 821, respectively. The spacer ring 822 isolates the package 821 from the valve casing 70, and the press ring 823 isolates the package 821 from the packing nut 83, thus protecting the package 821 and prolonging the service life of the package 821. For example, the spacer ring 822 and the press ring 823 can be metal pieces.

For example, as illustrated in FIG. 9, the fluid end further includes a packing sleeve 84 and a packing-sleeve nut 85, the plunger chamber 07*d* is configured to place the plunger 81, the packing sleeve 84 is located between the packing assembly 82 and the valve casing 70, and the packing-sleeve nut 85 is configured to press the packing sleeve 84.

For example, as illustrated in FIG. 9, the packing sleeve 84 is axially limited by a shoulder and the packing-sleeve nut 85.

For example, as illustrated in FIG. 9, at least one of the packing sleeve 84 and the packing-sleeve nut 85 is in a welded connection with the valve casing 70.

For example, as illustrated in FIG. 9, the hardness of the packing sleeve 84 is greater than the hardness of the valve casing 70. Because the hardness of the packing sleeve 84 is greater than the hardness of the valve casing 70, when the valve casing 70 is damaged, the packing; sleeve 84 will not be damaged, so the packing sleeve 84 and the valve casing 85 can be fixed by welding.

For example, as illustrated in FIG. 9, the outer circumference of the package 621 is in contact with the packing sleeve 84, and the inner circumference of the package 821 is in contact with the plunger 81. The front end of the packing sleeve 64 is provided with a sealing element 7008 to avoid fluid leakage and damage to the valve casing caused by high pressure fluid entering the gap. The packing sleeve 84 is a wear-resistant element, which is in interference fit with the valve casing 70. The hardness of the packing sleeve 84 is greater than the hardness of the valve casing. The packing sleeve 84 is provided to prevent the valve casing 70 from being damaged due to the rubbing of the package 821, thus prolonging the service life of the valve casing.

For example, as illustrated in FIG. 9, the inner and outer circumferences of the packing-sleeve nut 85 are provided with threads, the outer threads of the packing-sleeve nut 85 are matched with the valve casing 70, and the inner threads of the packing-sleeve nut 85 are matched with the packing nut 83. To prevent the packing-sleeve nut 85 from loosening, when the plunger 81 reciprocates, the packing-sleeve nut 85 can be fixed with the valve casing 70 by welding.

FIG. 9 further illustrates a discharge side 70*b* of the fluid end. The suction side 70*a* of the valve casing 70 is provided with an inlet hole 700, and the discharge side 70*b* is provided with a discharge hole 7005. For example, the inlet hole 700 is connected with the inlet manifold, and low pressure fluid flows inside; the discharge hole 7005 is connected with the discharge flange, and high pressure fluid flows inside.

FIG. 9 further illustrates the body 77 of the valve casing 70. The valve casing 70 includes a body 77 and an inner chamber 07.

For example, as illustrated in FIG. 8 and FIG. 9, the valve casing 70 is provided with suction side threads 7001, discharge side threads 7002, and plunger side threads 7003. The nut 20 is connected with the valve casing 70 through the suction side threads 7001. The nut 50 is connected with the valve casing 70 through the discharge side threads 7002. The packing-sleeve nut 85 is connected with the valve casing 70 through the plunger side threads 7003.

For example, as illustrated in FIG. 9, the first valve assembly V1 and the second valve assembly V2 are both unidirectional valves. For example, as illustrated in FIG. 9, the first valve assembly V1 and the second valve assembly V2 can be interchanged. For example, the second valve assembly V2 is placed vertically, the first valve assembly V1 is placed horizontally, and the axial directions of the first valve assembly V1 and the second valve assembly V2 are perpendicular to each other.

As illustrated in FIG. 4 and FIG. 9, for the first valve assembly V1, the valve seat 1*c* is arranged in the valve-seat groove 1013 of the cover 10, and the left side of the cover 10 serves as the base seat of the valve seat 1*c* and is configured to fix the valve seat 1*c*. For example, the cover 10 cooperates with the valve body 1*a*, the sealing element 1*b*, the spring 1*d*, and the spring bracket 1*e* to form a unidirectional valve. For example, the axis of the first valve assembly V1 coincides with the axis of the cover W. When the plunger moves back, the valve body 1*a* is opened, and the low pressure fluid enters the valve casing 70; when the plunger moves forward, the valve body 1*a* is closed, preventing the low pressure fluid from entering the valve casing 70.

For example, referring to FIG. 9, taking the fluid entering the fluid end as fracturing fluid as an example, the working principle of the fluid end is as follows.

During fluid suction, the plunger 81 moves back (moves to the left in a translation way), the first valve assembly V1 is opened, the second valve assembly V2 is closed, and the fracturing fluid flows into the pressure-alternating chamber 07*b* from the suction manifold through the inlet hole 700, the subsidiary flow channel 1022, and the main flow channel 1021 until the pressure-alternating chamber 07*b* is full of fracturing fluid; at this time, the fluid in the inner chamber 07 is low pressure fluid.

During fluid discharge, the plunger S1 moves forward (moves to the right in a translation way), the first valve assembly V1 is closed, the second valve assembly V2 is opened, and the fracturing fluid flows into the high pressure chamber 07*c* from the pressure-alternating chamber 07*b* and is discharged through the discharge hole 7005; at this time, the fluid in the inner chamber 07 is high pressure fluid.

The fluid end provided by the embodiment of the present disclosure has at least one of the following effects.

1) The stress concentration effect in the inner chamber is obviously alleviated.

There is no right angle at the intersection position of the inner chamber of the valve casing in the fluid end provided by the embodiment of the present disclosure, the transition of the intersection position of the inner chamber is smooth, the design in shape is carried out at the position where stress concentration is most likely to occur, the intersection position is in the shape of a bell mouth, there is no stress concentration point, and the stress concentration effect is obviously alleviated from the mechanical analysis.

2) The structure is simple and the sealing performance is strong.

The valve casing in the fluid end provided by the embodiment of the present disclosure has an integral structure, which is tightly sealed, and has high pressure resistant, uses fewer seals and does not need bolts, has a simple and compact structure, and has low risk of puncture leakage of the valve casing.

3) Maintenance is convenient.

According to the fluid end provided by the embodiment of the present disclosure, the axis of the plunger coincides with the first axis (horizontal axis) of the valve casing, the suction side is provided with a nut (the axis of the nut coincides with the axis of the plunger, and the nut is detachable), and the maintenance can be carried out according to the routine operation of the well site.

The embodiment of the present disclosure further provides a plunger pump, which includes any one of the fluid ends described above. Because the cover 10 is located at the suction side 70*a* of the fluid end, the cover 10 can also be referred to as a suction cover.

For example, the cover 10, and the fluid end and the plunger pump which include the cover 10, can be applied to fracturing/cementing equipment in oil and gas fields.

The embodiment t of the present disclosure provides a fluid end with two sets of pressure bearing assemblies at the suction side and a plunger pump including the fluid end, thus being beneficial to maintaining and prolonging the service life of the valve casing.

The fluid end and the plunger pump provided by the embodiment of the present disclosure are introduced below.

Figure 10:
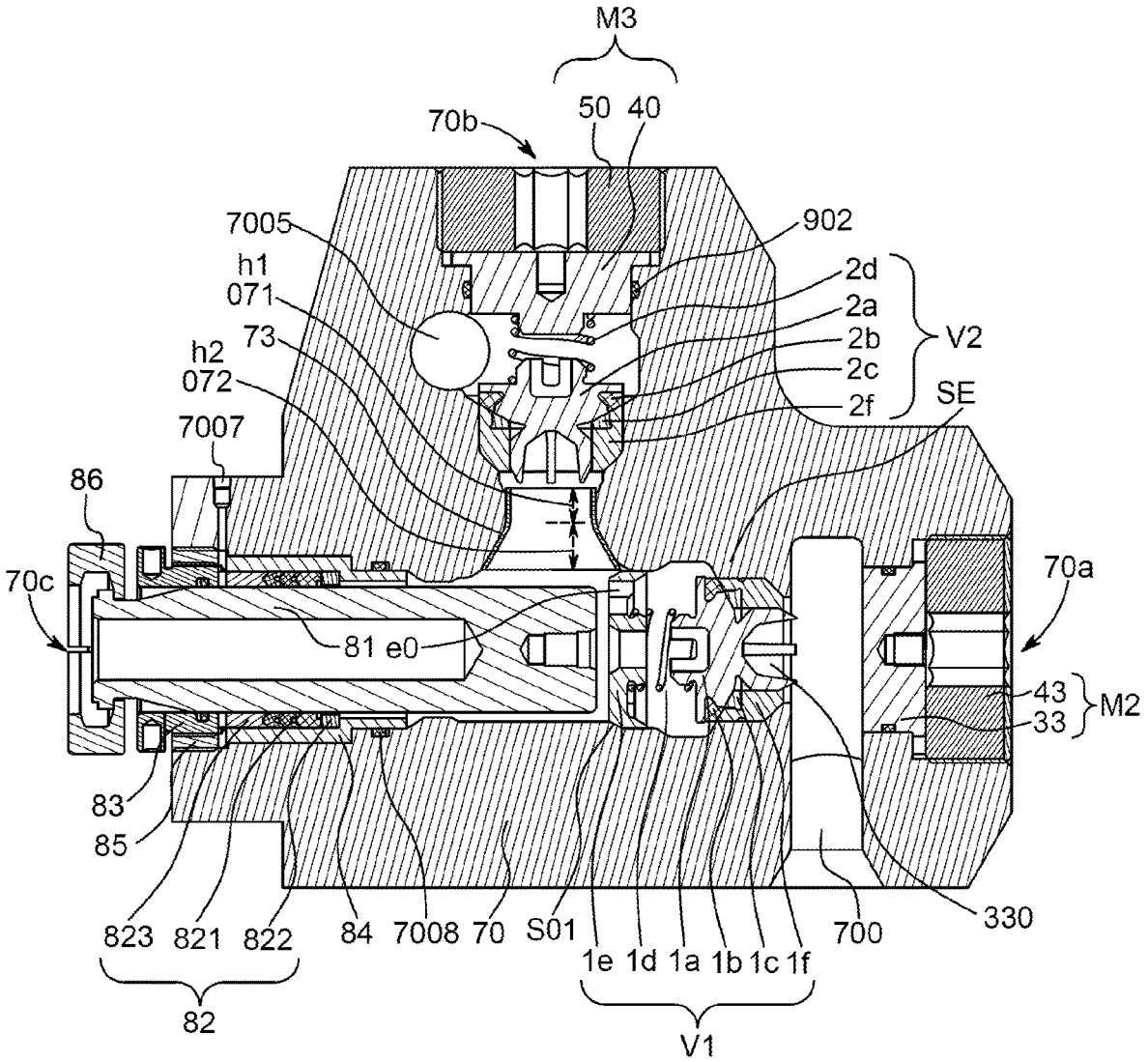
FIG. 10 is a cross-sectional view of a fluid end provided by an embodiment of the present disclosure.
Figure 11:
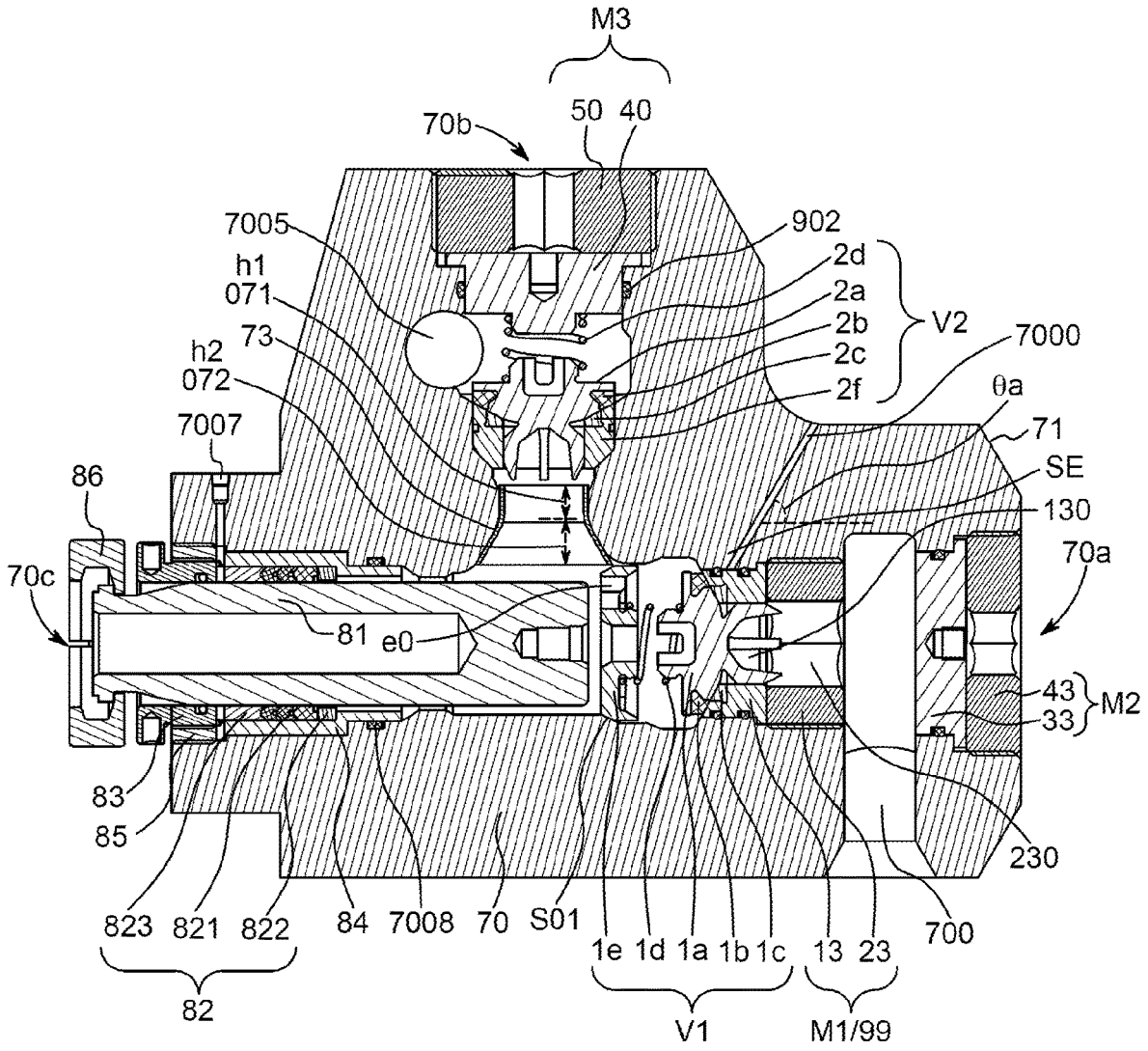
FIG. 11 is a cross-sectional view of a fluid end provided by an embodiment of the present disclosure.
Figure 12A:
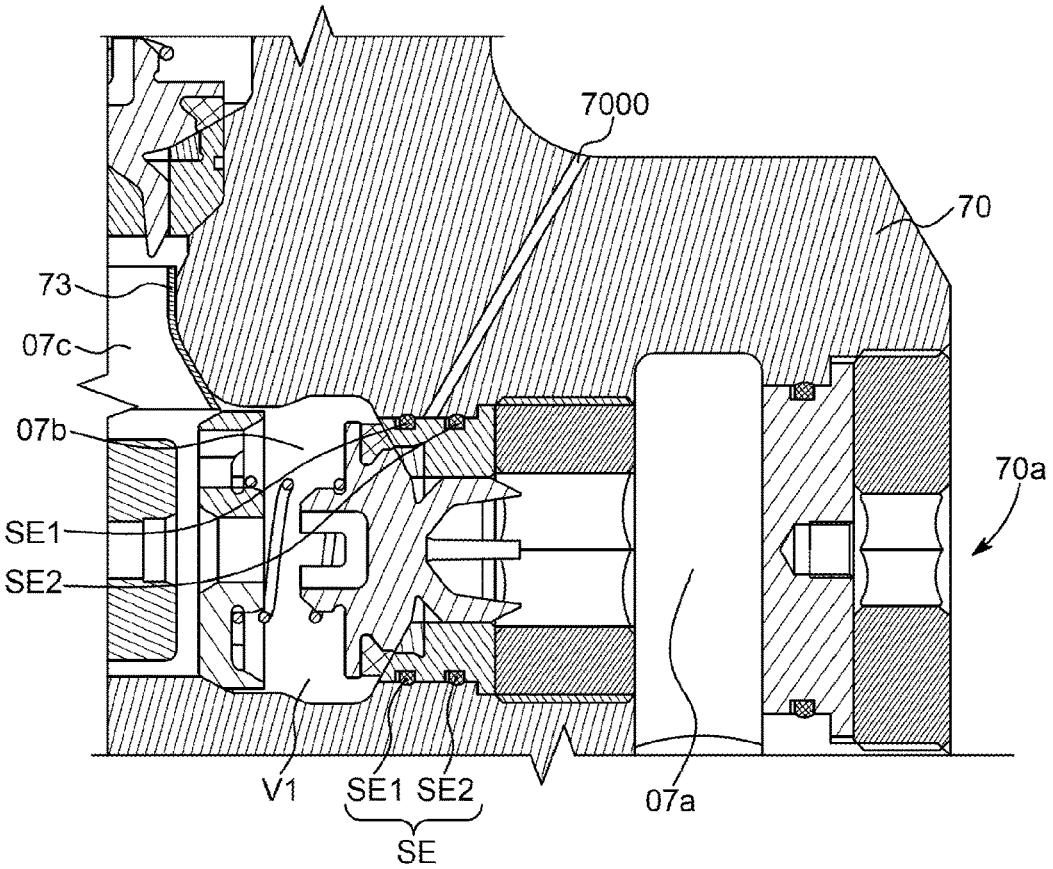
FIG. 12A is a partial view of a drain channel in a valve casing of FIG. 11.
Figure 12B:
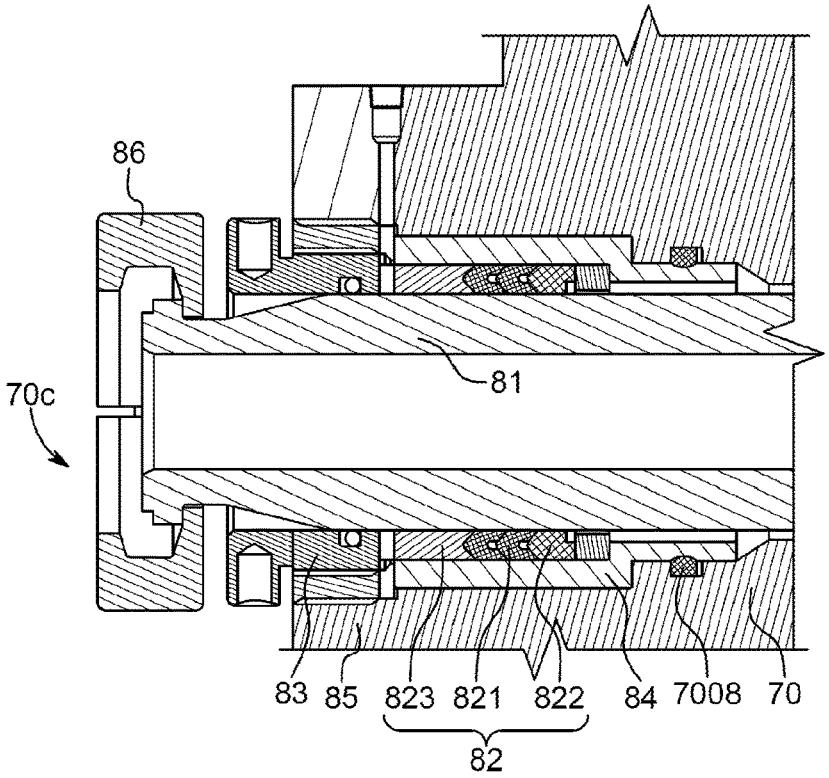
FIG. 12B is a partial view of a packing sleeve and a packing-sleeve nut in the valve casing of FIG. 10 or FIG. 11.
Figure 13:
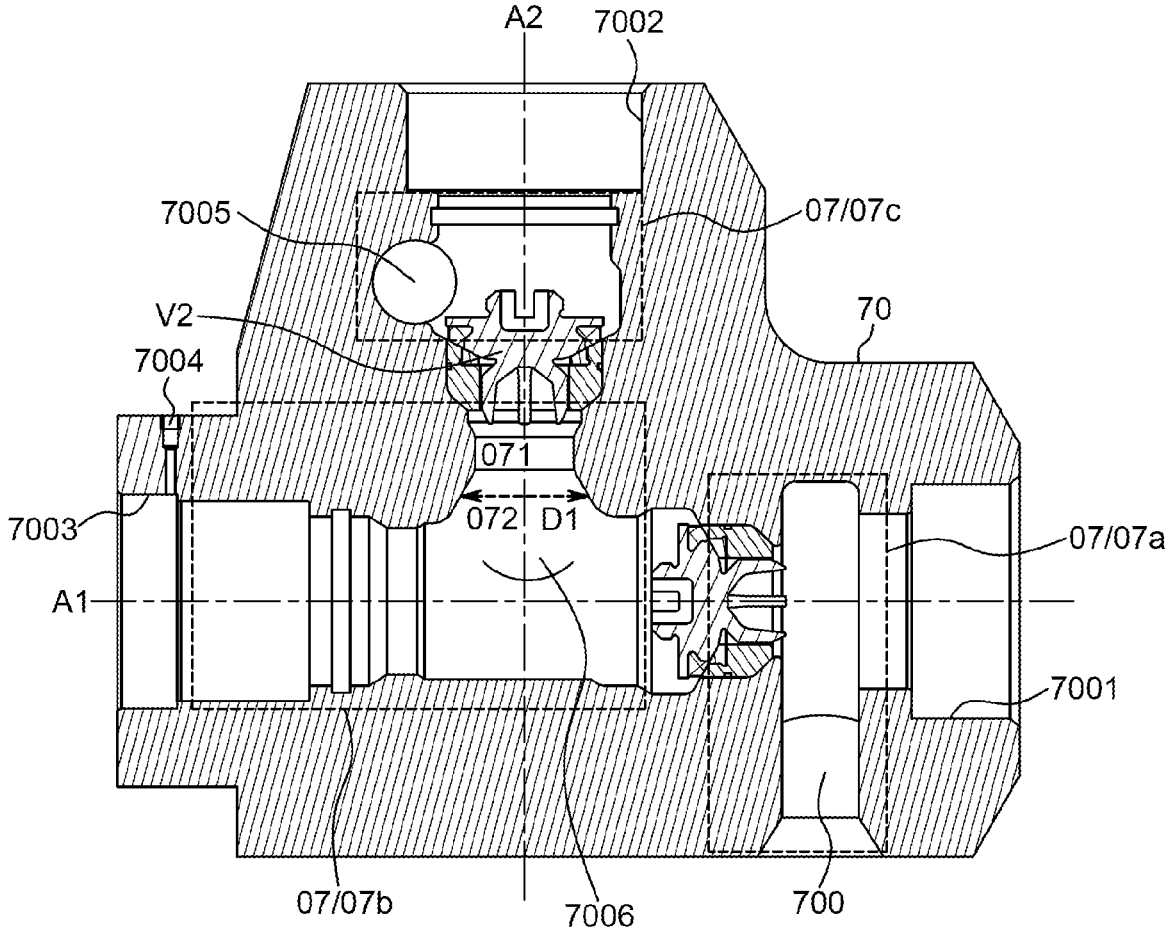
FIG. 13 is a schematic diagram of respective regions of an inner chamber in a valve casing of a fluid end provided by an embodiment of the present disclosure.
Figure 14:
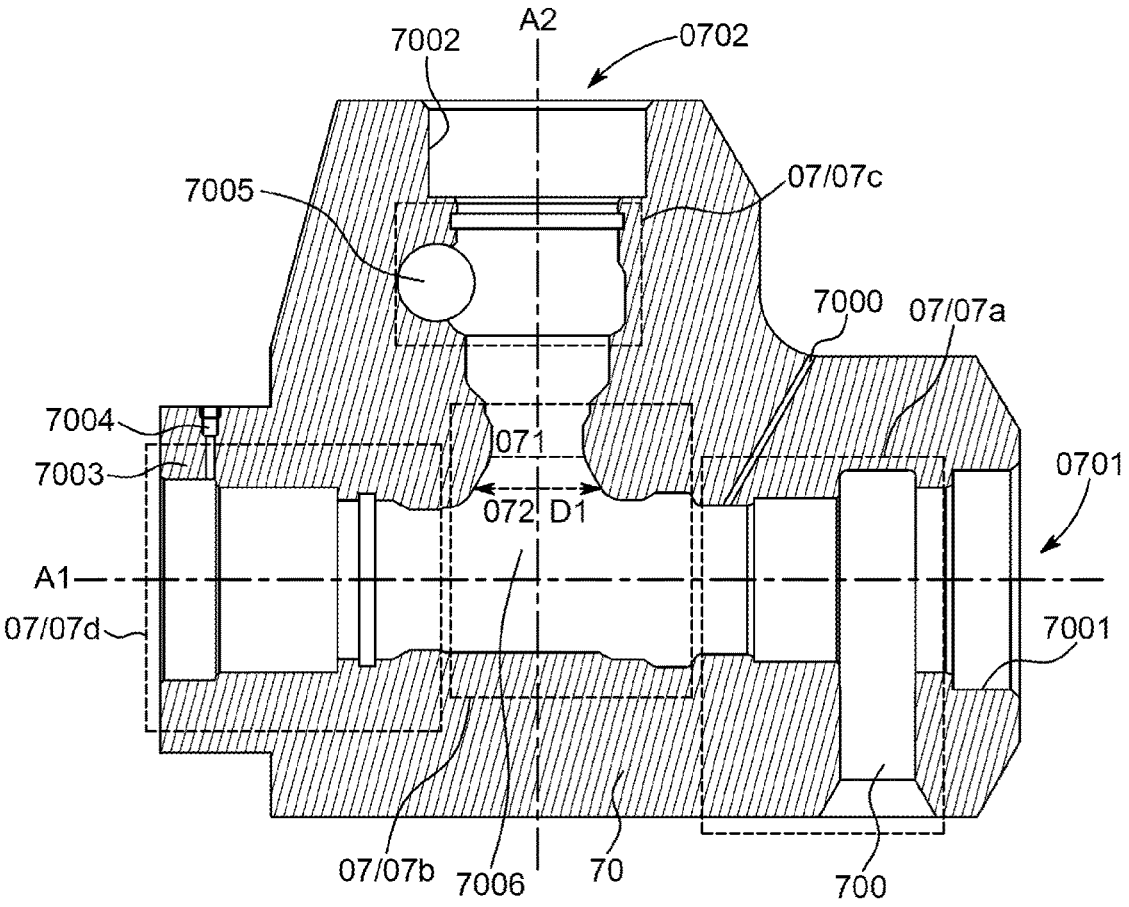
FIG. 14 is a schematic diagram of a valve casing in a fluid end provided by an embodiment of the present disclosure.
Figure 15:
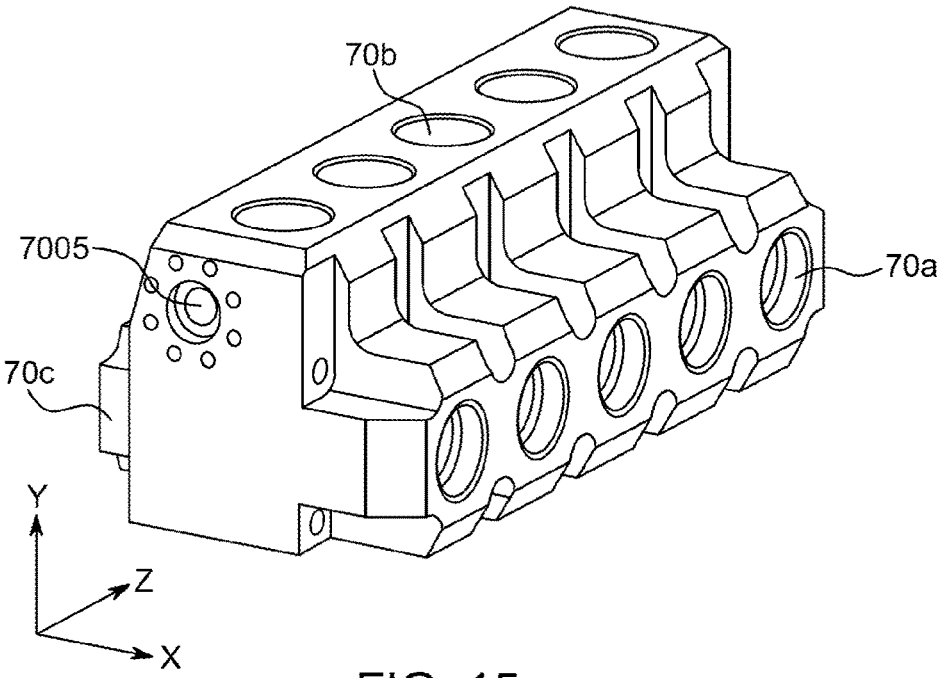
FIG. 15 is a perspective view of a fluid end provided by an embodiment of the present disclosure.
Figure 16:
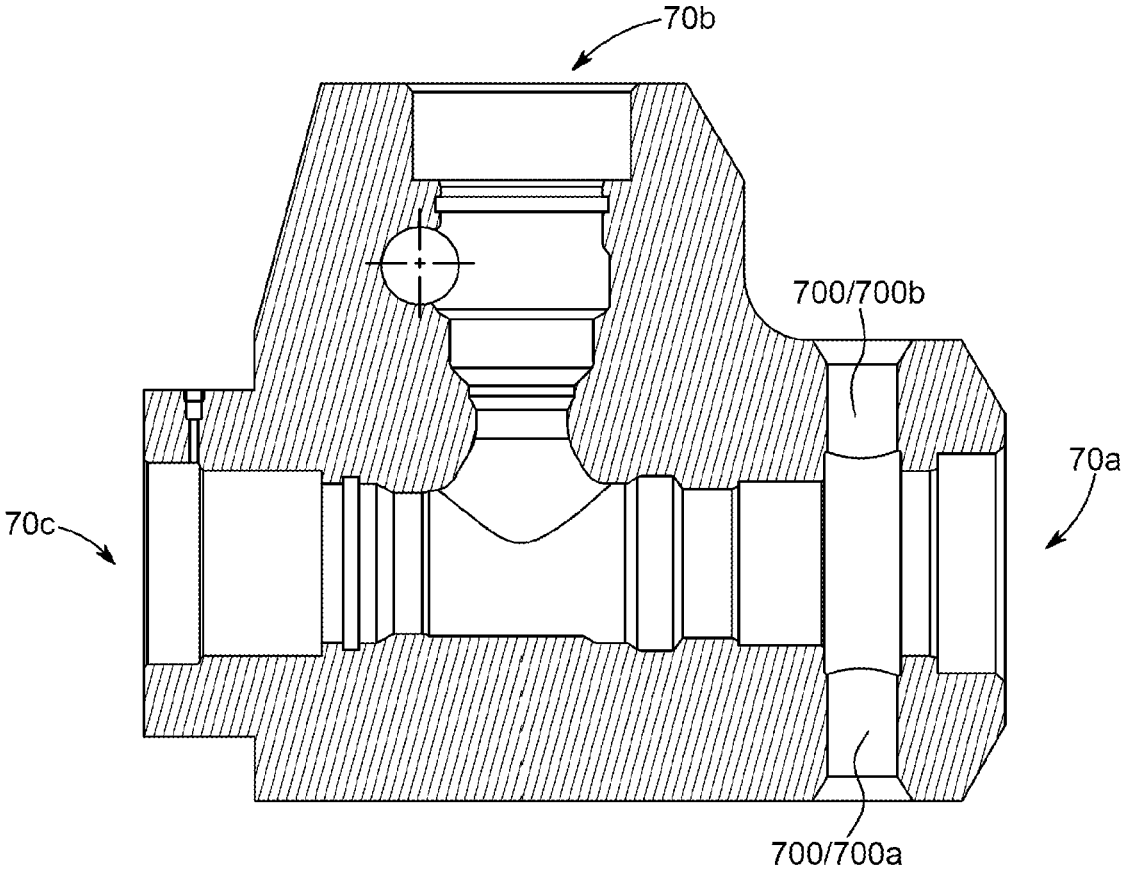
FIG. 16 is a schematic diagram of a valve casing in another fluid end provided by an embodiment of the present disclosure.
Figure 17A:
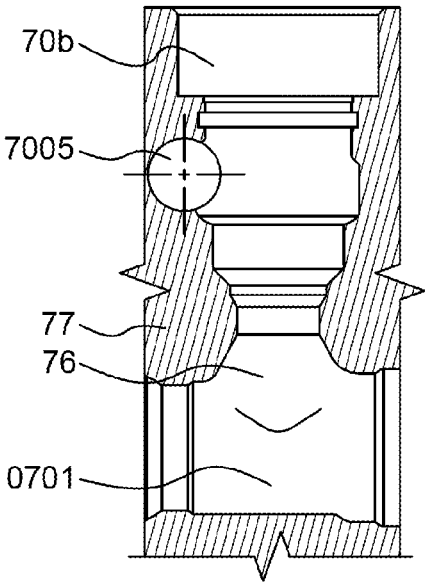
FIGS. 17A & 17B are schematic diagrams of an intersection position of an inner chamber of a valve casing in a fluid end provided by an embodiment of the present disclosure.
Figure 17B:
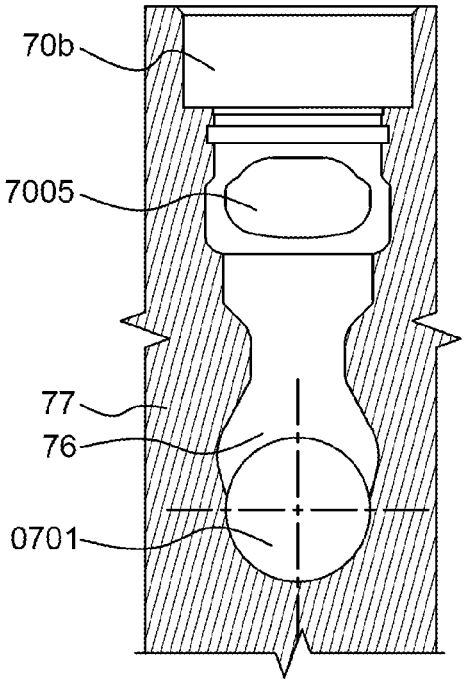
Figure 18A:
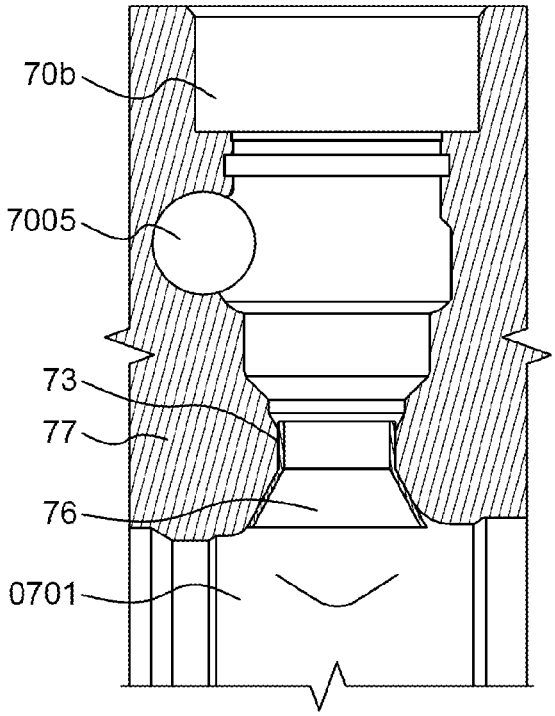
FIGS. 18A & 18B are schematic diagrams of a valve casing in another fluid end provided by an embodiment of the present disclosure.
Figure 18B:
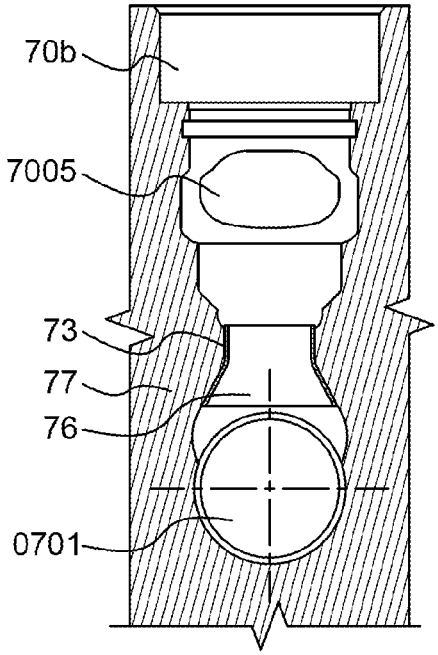

FIG. 10 is a cross-sectional view of a fluid end provided by an embodiment of the present disclosure. FIG. 11 is a cross-sectional view of a fluid end provided by an embodiment of the present disclosure. FIG. 12A is a partial view of a drain channel in a valve casing of FIG. 11. FIG. 12B is a partial view of a packing sleeve and a packing-sleeve nut in the valve casing of FIG. 11. FIG. 13 is a schematic diagram of respective regions of an inner chamber in a valve casing of a fluid end provided by an embodiment of the present disclosure. FIG. 14 is a schematic diagram of a valve casing in a fluid end provided by an embodiment of the present disclosure. FIG. 15 is a perspective view of a fluid end provided by an embodiment of the present disclosure. FIG. 16 is a schematic diagram of a valve casing in another fluid end provided by an embodiment of the present disclosure. FIG. 17 is a schematic diagram of an intersection position of an inner chamber of a valve casing in a fluid end provided by an embodiment of the present disclosure. FIG. 17(*a*) is a cross-sectional view of the XV plane of the inner chamber of the valve casing. FIG. 17 (*b*) is a schematic diagram of the YZ plane of the inner chamber of the valve casing. FIG. 18 is a schematic diagram of an intersection position of an inner chamber of a valve casing in another fluid end provided by an embodiment of the present disclosure. FIG. 18(*a*) is a cross-sectional view of the XV plane of the inner chamber of the valve casing. FIG. 18(*b*) is a schematic diagram of the YZ plane of the inner chamber of the valve casing. FIG. 15 illustrates the X direction, the V direction and the Z direction. For example, the X direction is the extending direction of the first axis A1 mentioned later, and the direction is the extending direction of the second axis A2 mentioned later.

For example, the valve casing illustrated in FIG. 8 is the valve casing in the fluid end illustrated in FIG. 9. For example, the valve casing illustrated in FIG. 13 is the valve casing in the fluid end illustrated in FIG. 10. For example, the valve casing illustrated in FIG. 14 is the valve casing in the fluid end illustrated in FIG. 11.

The fluid ends illustrated in FIG. 10 and FIG. 11 both include T-shaped valve casings. The inner chamber of the T-shaped valve casing is T-shaped. The fluid end illustrated in FIG. 10 includes one set of pressure bearing assembly, while the fluid end illustrated in FIG. 11 includes two sets of pressure bearing assemblies.

As illustrated in FIG. 11, the embodiment of the present disclosure provides a fluid end, which includes: a valve casing 70, a first valve assembly V1, a first pressure bearing assembly M1, and a second pressure bearing assembly M2.

As illustrated in FIG. 10, FIG. 11, FIG. 13 and FIG. 14, the valve casing 70 includes an inner chamber 07, and the inner chamber 07 includes a pressure-alternating chamber 07*b* and a low pressure chamber 07*a*.

As illustrated in FIG. 10, FIG. 11 and FIG. 13, the first valve assembly V1 is configured to be opened to communicate the low pressure chamber 07*a* with the pressure-alternating chamber 07*b* or configured to be closed to separate the low pressure chamber 07*a* from the pressure-alternating chamber 07*b*.

As illustrated in FIG. 11, the first pressure bearing assembly M1 is in contact with the first valve assembly V1.

As illustrated in FIG. 1, the second pressure bearing assembly M2 and the first: pressure bearing assembly M1 are arranged in sequence along the extending direction of the first axis A f of the inner chamber 07.

As illustrated in FIG. 11, the first valve assembly V1, the first pressure bearing assembly M1 and the second pressure bearing assembly M2 are sequentially arranged along the extending direction of the first axis A1 of the inner chamber 07.

FIG. 11 and FIG. 15 illustrate the suction side 70*a*, the discharge side 70*b*, and the plunger side 70*c* of the fluid end.

In the fluid end provided by the embodiment of the present disclosure, two sets of pressure bearing assemblies are arranged at the suction side 70*a*, that is, the first pressure bearing assembly M1 and the second pressure bearing assembly M2 are arranged. The first valve assembly V1 is connected with the valve casing 70 through the first pressure bearing assembly M1, instead of directly sitting on the valve casing 70. The first valve assembly V1 is not in direct contact with the valve casing, which is convenient for maintenance and beneficial to prolonging the service life of the valve casing.

For example, as illustrated in FIG. 11, the first pressure bearing assembly M1 is detachably connected with the valve casing 70, and the second pressure bearing assembly M2 is detachably connected with the valve casing 70, so as to facilitate disassembling the plunger 81 from the suction side 70*a*.

For example, as illustrated in FIG. 11, the first pressure bearing assembly M1 includes a pressure-alternating cover 13 and a pressure-alternating: nut 23, the pressure-alternating cover 13 is closer to the first valve assembly V1 than the pressure-alternating nut 23 is, and the pressure-alternating nut 23 is in a threaded connection with the valve casing 70.

For example, the pressure-alternating cover 13 bears an alternating load, and the pressure-alternating nut 23 bears an alternating load. The pressure-alternating cover 13 can also be referred to as an intermediate cover or directly referred to as a cover, and the pressure-alternating nut 23 can also be referred to as an intermediate nut or directly referred to as a nut.

For example, as illustrated in FIG. 11, the maximum length of the pressure-alternating cover 13 on the first axis A1 is less than the maximum length of the pressure-alternating nut 23 on the first axis A1.

In the fluid end provided by the embodiment of the present disclosure, the first valve assembly V1 is not directly seated on the valve casing 70, but indirectly connected with the valve casing 70 through the pressure-alternating cover 13. The pressure-alternating cover 13 will move under force, so it is necessary to use the pressure-alternating nut 23 for fixing and limiting. For example, the pressure-alternating nut 23 is in contact with the pressure-alternating cover 13, and the pressure-alternating nut 23 and the valve casing 70 are fastened by threads, which is not limited to this case. When the pressure-alternating cover 13 is subjected to an alternating load, the load will be transferred to the threads of the pressure-alternating nut 23. Because the contact area between the pressure-alternating cover 13 and the pressure-alternating nut 23 is small and the threads of the pressure-alternating nut 23 is long, the stress at the threads of the pressure-alternating nut 23 is less than the stress at the threads of the nut of the traditional fluid end through finite element analysis. The fluid end provided by the embodiment of the present disclosure can prolong the service life of the valve casing 70.

For example, as illustrated in FIG. 11 and FIG. 12A, a first sealing structure SE is provided between the pressure-alternating cover 13 and the valve casing 70, the valve casing 70 has a drain channel 7000, and the drain channel is configured to flow fluid therethrough in the case of failure of a part of the first sealing structure SE.

For example, as illustrated in FIG. 11 and FIG. 12A, the drain channel 7000 penetrates the body 100 of the valve casing 70. The drain channel 7000 penetrates into the inner chanter 07 from the outer side of the body 77 of the valve casing.

For example, as illustrated in FIG. 11 and FIG. 12A, in order to facilitate manufacturing and make the valve casino, have high strength, the drain channel 7000 is obliquely arranged with respect to the first axis A1 of the inner chamber 07, and the acute angle θa formed by the drain channel 7000 and the first axis A1 of the inner chamber 07 is greater than or equal to 30 degrees and less than or equal to 60 degrees.

For example, as illustrated in FIG. 11, the end of the drain channel 7000 that is away from the inner chamber 07 is closer to the suction side 70*a* than the end of the drain channel 7000 that is close to the inner chamber 07. That is, as illustrated in FIG. 11, the end of the drain channel 7000 that is away from the inner chamber 07 is further to the right than the end of the drain channel 7000 that is close to the inner chamber 07.

For example, as illustrated in FIG. 11 and FIG. 12A, the first sealing structure SE includes a first seal SE1 and a second seal SE2, and one, end of the drain channel 7000 close to the pressure-alternating cover 13 is located between the first seal SE1 and the second seal SE2 For example, the first seal SE1 includes a sealing ring, and the second seal SE2 includes a sealing ring.

As illustrated in FIG. 10 and FIG. 11, the sealing groove of the first sealing structure SE is provided in the pressure-alternating cover 13. In some other embodiments, the sealing groove of the first sealing structure SE can also be provided in the valve casing 70.

For example, as illustrated in FIG. 10 and FIG. 11, the first valve assembly V1 includes a valve body 1*a*, a sealing element 1*b*, and a valve seat 1*c*, and the pressure-alternating cover 13 serves as the base seat of the valve seat 1*c*.

For example, as illustrated in FIG. 10 and FIG. 11, the first valve assembly V1 further includes a spring 1 and a spring bracket 1*e*.

For example, as illustrated in FIG. 11, the spring bracket 1*e* includes a hollowed-out structure e0, and is limited with the valve casing 70 by an inclined surface S01. The spring bracket 1*e* with the hollowed-out structure e0 is beneficial to smoothing fluid passage, and is limited by the inclined surface S01, so as to prevent the spring bracket 1*e* from shaking in the horizontal chamber of the valve casing 70. Correspondingly, the horizontal chamber of the valve casing is also provided with an inclined surface to match with the inclined surface of the spring bracket 1*e*, and the spring bracket 1*e* is in contact with the valve casing 70 through the inclined surface.

For example, as illustrated in FIG. 11, the sealing element 1*b* is embedded in the valve body 1*a*. When the first valve assembly V1 is opened, the valve body 1*a* embedded with the sealing element 1*h* moves to the left, and the low pressure chamber 07*a* and the pressure-alternating chamber 07*b* are communicated with each other.

The first valve assembly V1 of the fluid end illustrated in FIG. 10 includes a base seat 1*f*. The pressure-alternating cover 13 in the fluid end illustrated in FIG. 11 serves as the base seat of the first valve assembly V1. Moreover, the valve casing of the fluid end illustrated in FIG. 11 is provided with a drain channel 7000, while the valve casing of the fluid end illustrated in FIG. 10 is not provided with a drain channel.

For example, as illustrated in FIG. 10, FIG. 11, FIG. 13, FIG. 14, and FIG. 16, the valve casing 70 has an inlet hole 700. FIG. 10, FIG. 11, FIG. 13, and FIG. 14 illustrate a single-side inlet hole. FIG. 16 illustrates dual-side inlet holes 700: the inlet hole 700*a* and the inlet hole 700*b*. The fluid feeding method of the valve casing 70 can be single-side fluid feeding or dual-side fluid feeding. For example, the single-side fluid feeding can meet the needs of the operation with small displacement and low sand ratio, and will not cause sand plugging; the dual-side fluid feeding can meet the needs of the operation with large displacement and high sand ratio, and dual-side inlet holes can ensure the stability of fluid feeding and reduce the risk of sand plugging.

For example, as illustrated in FIG. 11, the pressure-alternating cover 13 has a low pressure fluid channel 130, and the low pressure fluid channel 130 is communicated with the inlet hole 700 of the valve casing 70. The low pressure fluid channel 130 can also be referred to as a first channel 130.

For example, as illustrated in FIG. 11, the pressure-alternating nut 23 has a low pressure fluid channel 230, and the low pressure fluid channel 130 is communicated with the inlet hole 700 of the valve casing 70. The low pressure fluid channel 230 can also be referred to as a second channel 230.

For example, as illustrated in FIG. 11, the second pressure bearing assembly M2 includes a suction cover 33 and a suction nut 43. The suction cover 33 is closer to the first pressure bearing assembly M1 than the suction nut 43 is, and the suction nut 43 is in a threaded connection with the valve casing 70.

For example, as illustrated in FIG. 11, the first pressure bearing, assembly M1 and the second pressure bearing assembly M2 are arranged on opposite sides of the inlet hole 700, respectively. For example, as illustrated in FIG. 11, the first pressure bearing assembly M1 and the second pressure bearing assembly M2 are respectively arranged on both sides of the inlet hole 700 along the extending direction of the first axis A1. As illustrated in FIG. 11 the first pressure bearing assembly M1 is on the left side of the inlet hole 700, and the second pressure bearing assembly M2 is on the right side of the inlet hole 700.

For example, as illustrated in FIG. 11, the pressure-alternating cover 13 and the suction cover 33 are arranged on opposite sides of the pressure-alternating nut 23, respectively. For example, as illustrated in FIG. 11, the pressure-alternating nut 23 and the suction cover 33 are arranged on opposite sides of the inlet hole 700, respectively. As illustrated in FIG. 11, the pressure-alternating nut 23 is arranged on the left side of the inlet hole 700, and the suction cover 33 is arranged on the right side of the inlet hole 700.

The first valve assembly V1 of the fluid end illustrated in FIG. 4 includes a base seat 1*f*. The pressure-alternating cover 13 in the fluid end illustrated in FIG. 11 serves as the base seat of the first valve assembly V1, which makes the structure of the fluid end more compact. The base seat 1*f* illustrated in FIG. 4 has a low pressure fluid channel 330, and the low pressure fluid channel 330 is communicated with the inlet bole 700 of the valve casing 70.

For example, as illustrated in FIG. 10, FIG. 1, FIG. 13 and FIG. 14, the inner chamber 07 has an inverted T-shaped structure, the pressure-alternating chamber 07*b* and the high pressure chamber 07*c* are arranged along the extending direction of the second axis A2 of the inner chamber 07, and the first axis A1 intersects with the second axis A2. Therefore, the fluid end includes an inner chamber 07 with an inverted T-shaped structure, and the valve casing 70 can be referred to as a T-shaped valve casing. The embodiment of the present disclosure is illustrated by taking that the first axis A1 is perpendicular to the second axis A2 as an example.

For example, as illustrated in FIG. 11, the fluid end further includes a second valve assembly V2, and the inner chamber 07 further includes a high pressure chamber 07*c*. The second valve assembly V2 is configured to be opened to communicate the pressure-alternating chamber 07*b* with the high pressure chamber 07*c* or configured to be closed to separate the pressure-alternating chamber 07*b* form the high pressure chamber 07*c*.

For example, as illustrated in FIG. 11, the second valve assembly V2 includes a valve body 2*a*, a sealing element 2*b* (for sealing), a valve seat 2*c*, a spring 2*d* and a base seat 2*f*.

For example, as illustrated in FIG. 1.1, the sealing element 2*b* is embedded in the valve body 2*a*. When the second valve assembly V2 is opened, the valve body 2*a* embedded with the sealing element 2*b* moves upward, and the high pressure chamber 07*c* and the pressure-alternating chamber 07*b* are communicated with each other.

As illustrated in FIG. 11, the second valve assembly V2 is close to a discharge hole 7005, and is opened when the plunger moves forward, so as to flow high pressure fluid; the first valve assembly V1 is close to the inlet hole 700, and is opened when the plunger moves back, so as to flow low pressure fluid, the base seat 2*f* of the second valve assembly V2 is directly embedded in the valve casing 70, and the hardness of the base seat 2*f* is higher than the hardness of the valve casing 70, which can prevent the valve casing 70 from being damaged during opening and closing (slapping) of the second valve assembly V2 and prolong the service life of the valve casing 70.

For example, as illustrated in FIG. 11, the fluid end further includes a third pressure bearing assembly M3, the third pressure bearing assembly M3 is located in the inner chamber, and the third pressure bearing assembly M3 and the second valve assembly V2 are sequentially arranged in the extending direction of the second axis A2. A region of the inner chamber 07 between the second valve assembly V2 and the third pressure bearing assembly M3 is the high pressure chamber 07*c*.

As illustrated in FIG. 11, the third pressure bearing assembly M3 includes a cover 40 and a nut 50. The cover 40 can be referred to as a discharge cover 40, and the nut 50 can be referred to as a discharge nut 50.

For example, as illustrated in FIG. 11, the inlet hole 700 and the high pressure chamber 07*c* are staggered in the extending direction of the first axis A1.

For example, as illustrated in FIG. 11 and FIG. 14, the intersection position of the inner chamber 07 includes a first sub-chanter 071 and a second sub-chamber 072, the first sub-chamber 071 and the second sub-chamber 072 are arranged along the extending direction of the second axis A2. The second sub-chamber 072 is closer to the portion (horizontal chamber) of the inner chamber 07 extending along the first axis A1 than the first sub-chamber 071 is. In order to reduce stress concentration, the maximum size h2 of the second sub-chamber 072 in the extending direction of the second axis A2 is greater than the maximum size h1 of the first sub-chamber 071 in the extending direction of the second axis A2. The second valve assembly V2 is not placed in the first sub-chamber 071 and the second sub-chamber 072. The second valve assembly V2 is located at the outer side of the first sub-chamber 071 and the second sub-chamber 072. The first sub-chamber 071 and the second sub-chamber 072 can be empty cavities only for flowing fluid.

For example, as illustrated in FIG. 11 and FIG. 14, in order to reduce stress concentration, the site D1 of the second sub-chamber 072 in the extending direction of the first axis A1 gradually increases in a direction from a position away from the first axis A to a position close to the first axis A1 That is, the size D1 of the second sub-chamber 072 in the extending direction of the first axis A1 gradually increases from top to bottom.

For example, as illustrated in FIG. 11 and FIG. 14, the portion of the valve casing 70 for forming the second sub-chamber 072 has an included angle of 30-80 degrees with the first axis A1. Further, for example, the portion of the valve casing 70 for forming the second sub-chamber 072 has an included angle of 30-60 degrees with the first axis A1.

For example, as illustrated in FIG. 11, the first sub-chamber 071 is a cylindrical chamber, but it is not limited to this case. For example, as illustrated in FIG. 11, the second sub-chamber 072 is a truncated cone chamber, but it is not limited to this case.

For example, as illustrated in FIG. 11, the valve casing 70 is provided with a protective sleeve 73 at the position corresponding to both the first sub-chamber 071 and the second sub-chamber 072. There is a protective sleeve 73 at the "bell mouth" position of the inner chamber 07 of the valve casing 70 to protect the inner chamber 07 and prolong the service life of the valve casing 70.

For example, as illustrated in FIG. 11, the intersection position 7006 of the inner chamber 07 of the valve casing 70 forms a bell mouth shape by machining. For example, the bell mouth shape can be machined by means of boring, but it is not limited to this case.

For example, as illustrated in FIG. 4 and FIG. 11, a protective sleeve 73 is provided at the "bell mouth" position of the inner chamber of the valve casing 70 to prevent the inner chamber from being worn. After the inner chamber is worn, the roughness of the surface thereof will become larger, and coupled with high-pressure operation, the surface is prone to fatigue cracks. Therefore, the joint protection of "bell mouth" and protective sleeve 73 at the intersection position can reduce the risk of cracking and prolong the service life of valve casing. For example, the protective sleeve 73 can be installed at the inner side of the valve casing by means of cold installation, but it is not limited to cold installation, and the protective sleeve 73 can also be installed by means of machining or thermal processing.

FIG. 17 and FIG. 18 illustrate the bell mouth 76, the horizontal chamber 0701 and the body 77 of the valve casing 70.

The inner chamber of the valve casing of the fluid end provided by the embodiment of the present disclosure has a T-shaped structure, and the intersection position is designed in a "bell mouth" form, so that the problem of stress concentration at the intersection line of the inner chamber is alleviated.

For example, as illustrated in FIG. 11 and FIG. 14, the pressure-alternating cover 13 is located in the low pressure chamber 07*a*, the pressure-alternating nut 23 is located in the low pressure chamber 07*a*, the inner chamber 07 of the valve casing 70 has an inverted T-shaped structure, the pressure-altercating chamber 07*b* and the low pressure chamber 07*a* are arranged along the extending direction of the first axis A1 of the inner chamber 07, the pressure-alternating chamber 07*b* and the high pressure chamber 07*c* are arranged along the extending direction of the second axis A2 of the inner chamber 07, and the first axis A1 intersects with the second axis A2. FIG. 14 illustrates the first axis A1 and the second axis A2 of the inner chamber 07. As illustrated in FIG. 14, the inner chamber 07 includes a horizontal chamber 0701 and a vertical chamber 0702.

For example, as illustrated in FIG. 11 and FIG. 14, the inner chamber of the valve casing 70 has a T-shaped structure. According to the installation positions of the first valve assembly and the second valve assembly, the inner chamber 07 is divided into a low pressure chamber 07*a*, a pressure-alternating chamber 07*b*, and a high pressure chamber 07*c*. The intersection position of the inner chamber 07 is designed in a "bell mouth" form with smooth transition, which can effectively alleviate the stress concentration effect.

Compared with the valve casing in a traditional fluid end, the structural features of the valve casing in the fluid end provided by the embodiment of the present disclosure are as described above, and will not be repeated here.

The fluid end provided by the embodiment of the present disclosure does not have the above-mentioned problem of inconvenient maintenance, the axis of the plunger coincides with the first axis (horizontal axis) of the valve casing, the suction side is provided with a first pressure bearing assembly M1 and a second pressure bearing assembly M2, and the axis of the first pressure bearing assembly M1 and the axis of the second pressure bearing assembly M2 both coincide with the axis of the plunger, so the maintenance can be carried out according to the routine operation of the well site.

For example, as illustrated in FIG. 11, the pressure-alternating cover 13 has a revolving structure, which is horizontally placed inside the valve casing 70, with the left side in contact with the first valve assembly V1 and the right side in contact with the pressure-alternating nut 23. The pressure-alternating nut 23 is screwed with the valve casing 70.

For example, as illustrated in FIG. 11 and FIG. 12B, the fluid end includes a plunger 81. The plunger 81 is a revolving body, one end of the plunger 81 is in contact with the fluid in the valve casing 70 and reciprocates, and the other end of the plunger 81 is connected to the power end of the plunger pump through a clamp 86.

For example, as illustrated in FIG. 11 and FIG. 12B, the fluid end further includes a packing assembly 82, and the packing assembly 82 includes a package 821, a spacer ring 822, and a press ring 823.

For example, as illustrated in FIG. 11 and FIG. 12B, the package 821 includes three packing rings. Of course, the number of packing rings is not limited to that illustrated in the figure, but can be determined as needed. For example, the material of the packing ring includes rubber, but is not limited to this case.

For example, as illustrated in FIG. 11 and FIG. 12B, the plunger side 70*c* of the valve casing 70 is provided with a lubricating oil passage 7007 for lubricating the package 821 (rubber element), so as to make the reciprocating motion of the plunger 81 smoother the circumference of the plunger 81 is wrapped by the package 821, the package 821 plays a role of sealing to prevent fluid leakage when the plunger 81 reciprocates.

For example, as illustrated in FIG. 11 and FIG. 1213, the inner wall of the package 821 is in interference fit with the plunger 81, which plays a role of sealing; when the plunger 81 reciprocates, it rubs against the inner wall of the package 821, and the forced lubrication can reduce the friction.

For example, the front end of the plunger 81 is provided with a pulling hole (bolt hole), which is matched with a pulling tool. During maintenance, the clamp 86 is firstly disassembled and the plunger 81 is disconnected from the power end, and the plunger 81 is pulled out from the suction side 70*a* along the first axis A1 of the valve casing 71) by the pulling tool.

For example, as illustrated in FIG. 11 and FIG. 128, the fluid end further includes a packing nut 83, and the packing nut 83 is configured to press the packing assembly 82.

For example, as illustrated in FIG. 11 and FIG. 12B, the fixing of the package 821 is reinforced by the packing nut 83, and the packing nut 83 is in a threaded connection with the valve casing 70. The functions of the packing nut 83 include: preventing the package 821 from moving axially when the plunger 81 reciprocates, and expanding the package 821 by screwing and squeezing, which is beneficial to sealing. The spacer ring 822 and the press ring 823 are provided at both ends of the package 821, respectively. The spacer ring 822 isolates the package 821 from the valve casing 70, and the press ring 823 isolates the package 821 from the packing nut 83, thus protecting the package 821 and prolonging the service life of the package 821. For example, the spacer ring 822 and the press ring. 823 can be metal pieces.

For example, as illustrated in FIG. 11 and FIG. 12B, the fluid end further includes a packing sleeve 84 and a packing-sleeve nut 85, the plunger chamber 07*d* is configured to place the plunger 81, the packing sleeve 84 is located between the packing assembly 82 and the valve casing 70, and the packing-sleeve nut 85 is configured to press the packing sleeve 84.

For example, as illustrated in FIG. 11 and FIG. 12B, the packing sleeve 84 is axially limited by a shoulder and the packing-sleeve nut 85.

For example, as illustrated in FIG. 11 and FIG. 12B, at least one of the packing sleeve 84 and the packing-sleeve nut 85 is in a welded connection with the valve casing 70.

For example, as illustrated in FIG. 11 and FIG. 12B, the hardness of the packing sleeve 84 is greater than the hardness of the valve casing 70. Because the hardness of the packing sleeve 84 is greater than the hardness of the valve casing 70, when the valve casing 70 is damaged, the packing sleeve 84 will not be damaged, so the packing sleeve 84 and the valve casing 85 can be fixed by welding.

For example, as illustrated in FIG. 11 and FIG. 12B, the outer circumference of the package 821 is in contact with the packing sleeve 84, and the inner circumference of the package 821 is in contact with the plunger 81. The front end of the packing sleeve 84 is provided with a sealing element 7008 to avoid fluid leakage and damage to the valve casing caused by high pressure fluid entering the gap. The packing sleeve 84 is a wear-resistant element, which is in interference fit with the valve casing 70. The hardness of the packing sleeve 84 is greater than the hardness of the valve casing. The packing sleeve 84 is provided to prevent the valve casing 70 from being damaged due to the rubbing of the packing sleeve 821, thus prolonging the service life of the valve casing.

For example, as illustrated in FIG. 11 and FIG. 12B, the inner and outer circumferences of the packing-sleeve nut 85 are provided with threads, the outer threads of the packing-sleeve nut 85 are matched with the valve casing 70, and the inner threads of the packing-sleeve nut 85 are matched with the packing nut 83. To prevent the packing-sleeve nut 85 from loosening when the plunger 81 reciprocates, the packing-sleeve nut 85 can be fixed with the valve casing 70 by welding.

FIG. 11, FIG. 14 and FIG. 15 further illustrates a discharge side 70*b* of the fluid end. As illustrated in FIG. 11 and FIG. 15, the suction side 70*a* of the valve casing 70 is provided with an inlet hole 700, and the discharge side 70*b* is provided with a discharge hole 7005. For example, the inlet hole 700 is connected with the inlet manifold, and low pressure fluid flows inside, the discharge hole 7005 can be connected with the discharge flange, and high pressure fluid flows inside.

For example, as illustrated in FIG. 10, FIG. 11 and FIG. 14, the valve casing 70 is provided with suction side threads 7001, discharge side threads 7002 and plunger side threads 7003. The suction nut 43 is connected with the valve casing 70 through the suction side threads 7001. The nut 50 is connected with the valve casing 70 through the discharge side threads 7002. The packing-sleeve nut 85 is connected with the valve casing 70 through the plunger side threads 7003.

For example, as illustrated in FIG. 10 and FIG. 11, the first valve assembly V1 and the second valve assembly V2 are both unidirectional valves. For example, as illustrated in FIG. 10 and FIG. 11, the first valve assembly V1 and the second valve assembly V2 can be interchanged. For example, the second valve assembly V2 is placed vertically, the first valve assembly V1 is placed horizontally, and the axial directions of the first valve assembly V1 and the second valve assembly V2 are perpendicular to each other.

For example, as illustrated in FIG. 10 and FIG. 11, the second valve assembly V2 is placed vertically, the first valve assembly V1 is placed horizontally and the valve seats of the first valve assembly V1 and the second valve assembly V2 are fixed with the valve casing through conical surfaces. Due to the limitation of the aperture of the first valve assembly V1 illustrated in FIG. 10, the plunger cannot be pulled out from the suction side during maintenance and needs to be pulled out from the opposite side, which makes maintenance more complicated, but the scheme is simple and compact in structure and strong in interchangeability. Moreover, the valve seat and the base seat directly "sit" in the valve casing to bear alternating, load, the bearing surfaces are the conical surface and the inclined surface of the valve casing, the load will not be transferred to the threads on the suction side, so the valve casing has a long service life and strong stability. The valve body embedded with the sealing element forms a valve-body assembly, and the valve seat and the base seat form a valve-seat assembly. The valve-body assembly and the valve-seat assembly are matched by an inclined surface, the valve body is in rigid contact with the valve seat, the sealing element in the valve assembly is in non-rigid contact with the base seat, and the sealing element in the valve assembly plays a sealing role.

As illustrated in FIG. 11, for the first valve assembly V1, the valve seat 1*c* is arranged in the valve-seat groove of the pressure-alternating cover 13, and the left side of the pressure-alternating cover 13 serves as the base seat of the valve seat 1*c* and is configured to fix the valve seat 1*c*. For example, the pressure-alternating cover 13 cooperates with the valve body 1*a*, the sealing element 1*b*, the spring 1*d*, and the spring bracket 1*e* to form a unidirectional valve. For example, the axis of the first valve assembly V1 coincides with the axis of the pressure-alternating cover 13. When the plunger moves back, the valve body 1*a* is opened, and the low pressure fluid enters the valve casing 70; when the plunger moves forward, the valve body 1*a* is closed, preventing the low pressure fluid from entering the valve casing 70.

For example, referring to FIG. 11, taking the fluid entering the fluid end as fracturing fluid as an example, the working principle of the fluid end is as follows.

During liquid suction, the plunger 81 moves back (translates to the left), the first valve assembly V1 is opened, the second valve assembly V2 is closed, and the fracturing fluid flows into the pressure-alternating chamber 07*b* from the suction manifold through the inlet hole 700, the low pressure fluid channel 230, and the low pressure fluid channel 130 until the pressure-alternating chamber 07*h* is full of fracturing fluid; at this time, the fluid in the inner chamber 07 is low pressure fluid.

During fluid discharge, the plunger 81 moves forward (translates to the right), the first valve assembly V1 is closed, the second valve assembly V2 is opened, and the fracturing fluid flows into the high pressure chamber 07*c* from the pressure-alternating chamber 07*b* and is discharged through the discharge hole 7005; at this time, the fluid in the inner chamber 07 is high pressure fluid.

Figure 19:
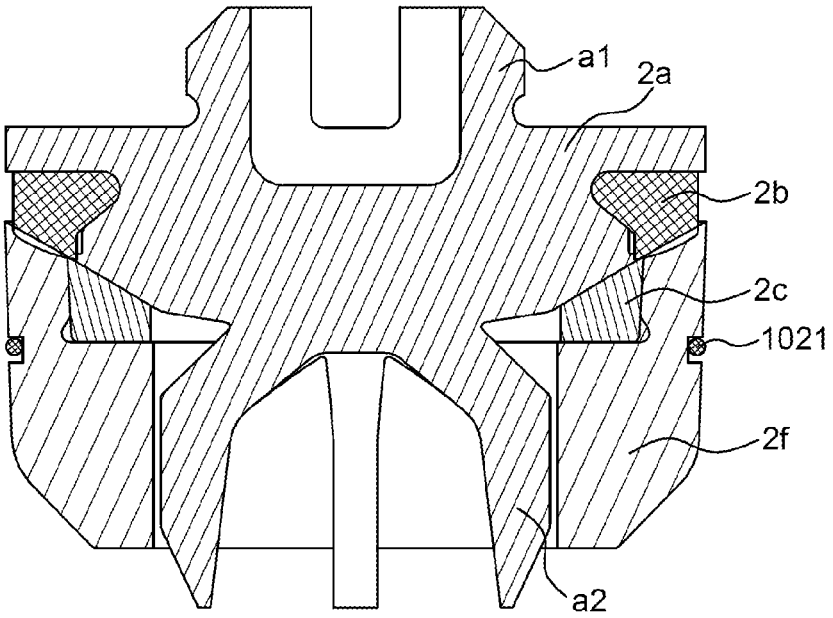
FIG. 19 is a schematic diagram of a second valve assembly in a fluid end provided by an embodiment of the present disclosure.

FIG. 19 is a schematic diagram of a second valve assembly in a fluid end provided by an embodiment of the present disclosure. As illustrated in FIG. 19, the valve body 2*a* includes a lug boss a1 and a clamping jaw a2. The function of the lug boss a1 includes limiting the spring 2*d* to prevent the spring 2*d* from moving radially. The function of the lug boss a1 also includes limiting the opening height of the valve body 2*a*. When the second valve assembly V2 is opened, the lug boss a1 of the valve body 2*a* is in rigid contact with the lug boss of the discharge cover 40, so that the opening height of each time is uniform.

As illustrated in FIG. 19, the inner hole of the base seat 2*f* is in clearance fit with the clamping jaw a2, so as to guide the clamping jaw a2 and prevent the valve body 2*a* from deflecting under the impact of high pressure fluid. The valve seat 2*c* and the base seat 21 have a separated structure, and the hardness of the valve seat 2*c* is greater than the hardness of the base seat 2*f* The purpose is to prevent the inclined surface of the valve seat 2*c* from being worn when the valve body 2*a* slaps the valve seat 2*c*, to avoid poor sealing caused by wearing the valve seat 2*c*, and to avoid reducing the service life of the valve seat and the valve body.

The structure and function of the first valve assembly can be referred to the above description. The difference is that the lug boss of the valve body 1*a* is in rigid contact with the lug boss of the spring bracket.

Figure 20:
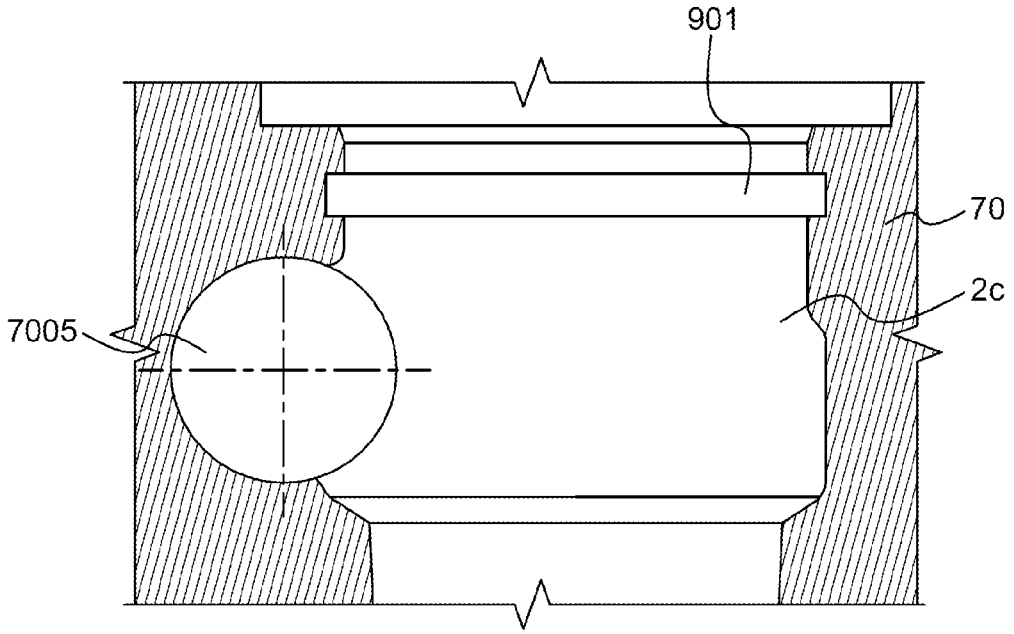
FIG. 20 is a schematic diagram of a valve casing on a discharge side of a fluid end provided by an embodiment of the present disclosure.
Figure 21:
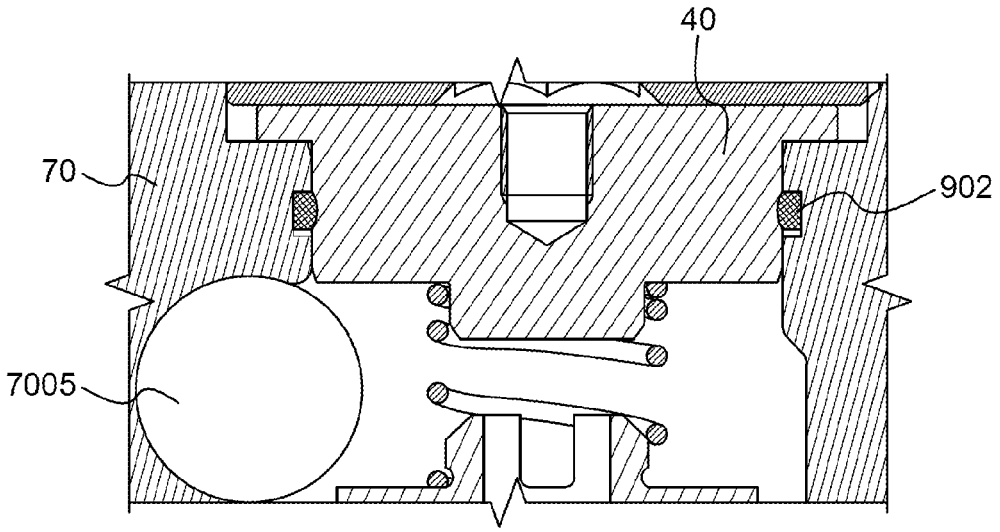
FIG. 21 is a schematic diagram of a sealing structure on a discharge side of a fluid end provided by an embodiment of the present disclosure.
Figure 22:
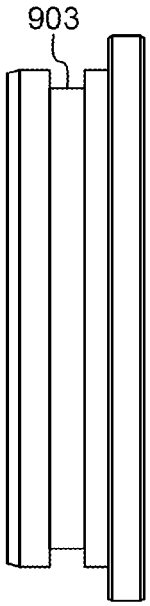
FIG. 22 is a schematic diagram of a valve casing on a suction side of a fluid end provided by an embodiment of the present disclosure.
Figure 23:
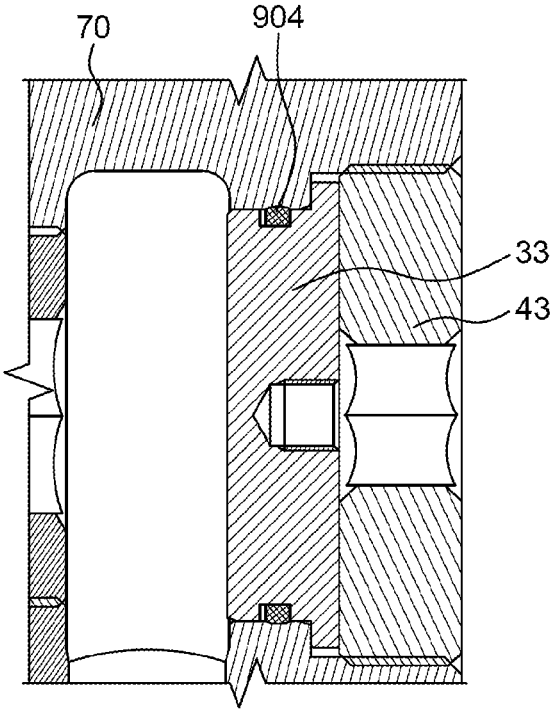
FIG. 23 is a schematic diagram of a sealing structure on a suction side of a fluid end provided by an embodiment of the present disclosure.

FIG. 20 is a schematic diagram of a valve casing on a discharge side of a fluid end provided by an embodiment of the present disclosure. FIG. 21 is a schematic diagram of a sealing structure on a discharge side of a fluid end provided by an embodiment of the present disclosure. FIG. 22 is a schematic diagram of a valve casing on a suction side of a fluid end provided by an embodiment of the present disclosure. FIG. 23 is a schematic diagram of a sealing structure on a suction side of a fluid end provided by an embodiment of the present disclosure.

FIG. 19 illustrates a sealing element 1021, the sealing element 1021 includes a sealing ring, and a sealing groove is provided at the corresponding position of the base seat 2*f*. As illustrated in FIG. 10 and FIG. 11, the sealing element 1021 is provided to realize the sealing between the second valve assembly V2 and the valve casing 70.

FIG. 20 illustrates a sealing, groove 901, and FIG. 21 illustrates a sealing element 902. The sealing element. 902 is provided to seal the high pressure chamber of the inner chamber.

FIG. 22 illustrates a sealing groove 903, and FIG. 23 illustrates a sealing element 904. The sealing element 904 is provided to seal the low pressure chamber of the inner chamber.

For example, the sealing element and the groove for receiving the sealing, element can be referred to as a sealing structure. For example, the sealing element 904 and the groove for receiving the sealing element 904 can be referred to as a second sealing structure, and the sealing element 902 and the groove for receiving the sealing element 902 can be referred to as a third sealing structure. The sealing element includes a sealing ring.

For example, in the embodiment of the present disclosure, the fluid end includes: a valve casing, including an inner chamber, the inner chamber including a pressure-alternating chamber and a low pressure chamber; a first valve assembly, located in the inner chamber, and configured to be opened to communicate the low pressure chamber with the pressure-alternating chamber or configured to be closed to separate the low pressure chamber from the pressure-alternating chamber; a pressure bearing structure 99, at least a part of the pressure bearing structure 99 being located in the low pressure chamber, and a first sealing structure, located between the pressure bearing structure 99 and the valve casing. At least one of the valve casing and the pressure bearing structure 99 has a drain channel, and the drain channel is configured to flow fluid therethrough in the case of failure of a part of the first sealing structure. For example, the pressure bearing structure 99 is located in the inner chamber.

For example, the drain channel can be the drain channel 1000 or the drain channel 7000 as described above.

For example, in some embodiments, as illustrated in FIG. 7 and FIG. 9, the pressure bearing structure 99 can include the cover 10 described above. In this case, the drain channel 1000 is provided in the cover 10.

For example, as illustrated in FIG. 7 and FIG. 9, the pressure bearing structure 99 includes a cover 10 and a nut 20, the nut 20 is screwed with the valve casing 70, and the drain channel 100 is located in the cover 10.

For example, in some other embodiments, as illustrated in FIG. 11, the pressure bearing structure 99 can include the first pressure bearing assembly M1 described above. In this case, the drain channel 7000 is provided in the valve casing 70.

For example, the first sealing structure can be the first sealing structure 101*s* or the first sealing structure SE as described above.

For example, as illustrated in FIG. 9, the first sealing structure 101*s* includes a first seal SL1 and a second seal SL2, the drain channel 1000 includes a first drain outlet 1001 and a second drain outlet 1002, the first drain outlet 1001 is closer to the first sealing structure 101*s* than the second drain outlet 1002 is, and the first drain outlet 1001 is located between the first seal SL1 and the second seal SL2.

For example, as illustrated in FIG. 12A, the first sealing structure SE includes a first seal SE1 and a second seal SE2, the drain channel 1000 includes a first drain outlet 1001 and a second drain outlet 1002, the first drain outlet 1001 is closer to the first sealing structure 101*s* than the second drain outlet 1002 is, and the first drain outlet 1001 is located between the first seal SE1 and the second seal SE2.

For example, as illustrated in FIG. 11, the pressure bearing structure 99 includes a first pressure bearing assembly M1 and a second pressure bearing assembly M2, and the first valve assembly V1, the first pressure bearing assembly M1 and the second pressure bearing assembly M2 are arranged in sequence along the extending direction of the first axis A1 of the inner chamber.

For example, as illustrated in FIG. 11, the first pressure bearing assembly M1 includes a pressure-alternating cover 13 and a pressure-alternating nut 23. The pressure-alternating cover 13 is closer to the first valve assembly V1 than the pressure-alternating nut 23 is, and the pressure-alternating nut 23 is screwed with the valve casing 70.

The arrangement of the components on the left side of the fluid end illustrated in FIG. 10 and FIG. 11, such as the packing assembly 82, the packing nut 83, the packing sleeve 84 and the packing sleeve nut 85, etc., can be referred to the above description, and will not be repeated here.

The embodiment of the present disclosure further provides a plunger pump, which includes any one of the fluid ends described above.

For example, the fluid end and the plunger pump described above can be applied to fracturing/cementing equipment in oil and gas fields.

What have been described above are only specific implementations of the present disclosure, the protection scope of the present disclosure is not limited thereto. Any modifications or substitutions easily occur to those skilled in the art within the technical scope of the present disclosure should be within the protection scope of the present disclosure. Therefore, the protection scope of the present disclosure should be based on the protection scope of the claims.

What is claimed is:

1. A cover, comprising comprises: a body, the body being cylindrical, and the body comprising a first end, a second end, and a side surface connecting the first end and the second end; a main flow channel extending along an axis of the body; a plurality of subsidiary flow channels, each of the plurality of subsidiary flow channels being communicated with the main flow channel; a first opening located at the first end of the body and communicated with the main flow channel; a plurality of second openings located at the side surface of the body, each of the plurality of subsidiary flow channels being communicated with at least one of the plurality of second openings; a drain channel with a first end and a second end, a first drain outlet located at the first end of the drain channel, and a second drain outlet located at the second end of the drain channel, wherein the first drain outlet is located at the side surface of the body, and the second drain outlet is located at an end surface of the second end of the body; and a first sealing groove and a second sealing groove, wherein the first sealing groove is configured to receive a first sealing ring, the second sealing groove is configured to receive a second sealing ring, the first sealing groove and the second sealing groove are both located at the side surface, and the first drain outlet is located between the first sealing groove and the second sealing groove.

2. The cover according to claim 1, wherein the main flow channel is located on the axis of the body, and the main flow channel does not penetrate the body on the axis of the body.

3. The cover according to claim 1, wherein an aperture of the main flow channel is larger than an aperture of the subsidiary flow channel.

4. The cover according to claim 1, wherein each of the plurality of subsidiary flow channels are obliquely arranged with respect to the main flow channel.

5. The cover according to claim 4, wherein an acute angle between a center line of each subsidiary flow channel of the plurality of subsidiary flow channels and a center line of the main flow channel is in a range from 20 to 80 degrees.

6. The cover according to claim 4, wherein a distance between each subsidiary flow channel of the plurality of subsidiary flow channels and the axis of the body gradually increases in a direction from the first end of the body to the second end of the body.

7. The cover according to claim 1, wherein the drain channel is not communicated with the main flow channel, and is not communicated with the plurality of subsidiary flow channels.

8. The cover according to claim 1, wherein the first drain outlet is located at a side of the side surface close to an end surface of the first end of the body.

9. The cover according to claim 1, further comprising a valve-seat groove, wherein the valve-seat groove is located at the first end of the body and is communicated with the main flow channel, and the valve-seat groove has a relief groove at a side of the valve-seat groove away from the first end of the body.

10. The cover according to claim 1, further comprising a pulling hole, wherein the pulling hole is located at the second end of the body, the pulling hole is not communicated with the second drain outlet, and the pulling hole is located on the axis of the body.

11. A fluid end, comprising a cover, wherein the cover comprises: a body, the body being cylindrical, and the body comprising a first end, a second end, and a side surface connecting the first end of the body and the second end of the body; a main flow channel extending along an axis of the body; a plurality of subsidiary flow channels, each of the plurality of subsidiary flow channels being communicated with the main flow channel; a first opening located at the first end of the body and communicated with the main flow channel; a plurality of second openings located at the side surface of the body, each of the plurality of subsidiary flow channels being communicated with at least one of the plurality of second openings; a drain channel with a first end and a second end, a first drain outlet located at the first end of the drain channel, and a second drain outlet located at the second end of the drain channel, wherein the first drain outlet is located at the side surface of the body, and the second drain outlet is located at an end surface of the second end of the body; and a first sealing groove and a second sealing groove, wherein the first sealing groove is configured to receive a first sealing ring, the second sealing groove is configured to receive a second sealing ring, the first sealing groove and the second sealing groove are both located at the side surface, and the first drain outlet is located between the first sealing groove and the second sealing groove.

12. The fluid end according to claim 11, further comprising:

a valve casing comprising an inner chamber, wherein the inner chamber comprises a low pressure chamber, a pressure-alternating chamber, and a high pressure chamber; the cover is located in the low pressure chamber, the inner chamber of the valve casing has an inverted T-shaped structure, the pressure-alternating chamber and the low pressure chamber are arranged along an extending direction of a first axis of the inner chamber, the pressure-alternating chamber and the high pressure chamber are arranged along an extending direction of a second axis of the inner chamber, and the first axis intersects with the second axis.

13. The fluid end according to claim 12, wherein the valve casing has an inlet hole, and the inlet hole and the high pressure chamber are staggered in the extending direction of the first axis.

14. The fluid end according to claim 12, further comprising: a first valve assembly, wherein the first valve assembly is configured to be opened to communicate the low pressure chamber with the pressure-alternating chamber or configured to be closed to separate the low pressure chamber from the pressure-alternating chamber, the first valve assembly comprises a spring bracket, and the spring bracket has a hollowed-out structure and is limited with the valve casing by an inclined surface.

15. The fluid end according to claim 12, wherein a first sub-chamber and a second sub-chamber are provided at an intersection position of the inner chamber, the first sub-chamber and the second sub-chamber are arranged along an extending direction of the second axis, and the second sub-chamber is closer to a portion of the inner chamber extending along the first axis than the first sub-chamber is, a maximum size of the second sub-chamber in the extending direction of the second axis is greater than a maximum size of the first sub-chamber in the extending direction of the second axis, and a size of the second sub-chamber in the extending direction of the first axis gradually increases in a direction from a position away from the first axis to a position close to the first axis.

16. The fluid end according to claim 15, wherein the valve casing is provided with a protective sleeve at a position corresponding to both the first sub-chamber and the second sub-chamber.

17. The fluid end according to claim 15, further comprising a second valve assembly, wherein the second valve assembly is configured to be opened to communicate the pressure-alternating chamber with the high pressure chamber or configured to be closed to separate the pressure-alternating chamber from the high pressure chamber, and the second valve assembly and the second sub-chamber are located at opposite sides of the first sub-chamber.

18. A plunger pump, comprising the fluid end according to claim 11.

* * * * *